US009726409B2

(12) United States Patent
Yamashita et al.

(10) Patent No.: US 9,726,409 B2
(45) Date of Patent: Aug. 8, 2017

(54) AIR-CONDITIONING APPARATUS

(75) Inventors: Koji Yamashita, Tokyo (JP); Toshihide Koda, Tokyo (JP); Hiroyuki Morimoto, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 186 days.

(21) Appl. No.: 14/114,962

(22) PCT Filed: Jun. 14, 2011

(86) PCT No.: PCT/JP2011/003383

§ 371 (c)(1),
(2), (4) Date: Dec. 13, 2013

(87) PCT Pub. No.: WO2012/172597

PCT Pub. Date: Dec. 20, 2012

(65) Prior Publication Data

US 2014/0090409 A1 Apr. 3, 2014

(51) Int. Cl.
*F25B 41/00* (2006.01)
*F25B 49/00* (2006.01)
(Continued)

(52) U.S. Cl.
CPC ..... *F25B 49/00* (2013.01); *F25B 9/006* (2013.01); *F25B 13/00* (2013.01); *F25B 49/02* (2013.01);
(Continued)

(58) Field of Classification Search
CPC ..... F25B 49/02; F25B 9/006; F25B 2500/19; F25B 2600/21
See application file for complete search history.

(56) References Cited

U.S. PATENT DOCUMENTS 4,441,901 A * 4/1984 Endoh ..... F24F 5/001 165/240
5,009,078 A * 4/1991 Ohkoshi ..... F24F 3/065 62/160
(Continued)

FOREIGN PATENT DOCUMENTS

JP 06-101912 A 4/1994
JP 08-075280 A 3/1996
(Continued)

OTHER PUBLICATIONS

Hideki et al., Refrigeration Device and Refrigerant Filling Method, Oct. 1, 2009, JP2009222356A, Whole Document.*
(Continued)

*Primary Examiner* — Justin Jonaitis
*Assistant Examiner* — Larry Furdge
(74) *Attorney, Agent, or Firm* — Posz Law Group, PLC

(57) ABSTRACT

An air-conditioning apparatus includes a controller which calculates a composition ratio of a refrigerant mixture using a high-pressure-side pressure of a refrigerant discharged from a compressor, a low-pressure-side pressure of a refrigerant to be sucked into the compressor, a high-pressure-side temperature of a refrigerant at an inlet side of a second expansion device in a high/low pressure bypass pipe, and a low-pressure-side temperature of a refrigerant at an outlet side of the second expansion device in the high/low pressure bypass pipe and which determines whether to open or close a bypass-channel opening/closing device.

10 Claims, 13 Drawing Sheets

(51) Int. Cl.

| | |
|---|---|
| ***F25B 9/00*** | (2006.01) |
| ***F25B 13/00*** | (2006.01) |
| ***F25B 49/02*** | (2006.01) |
| *F25B 25/00* | (2006.01) |

(52) U.S. Cl.

CPC ..... *F25B 25/005* (2013.01); *F25B 2313/023* (2013.01); *F25B 2313/0272* (2013.01); *F25B 2313/02732* (2013.01); *F25B 2313/02741* (2013.01); *F25B 2400/08* (2013.01); *F25B 2600/2501* (2013.01)

(56) References Cited

U.S. PATENT DOCUMENTS

| | | | | | |
|---|---|---|---|---|---|
| 5,353,604 | A * | 10/1994 | Oguni | F25B 49/02 | 62/207 |
| 5,996,358 | A * | 12/1999 | Sumida | C09K 5/045 | 62/114 |
| 2006/0254294 | A1* | 11/2006 | Shimamoto | F24F 3/065 | 62/238.7 |
| 2007/0062207 | A1* | 3/2007 | Aiyama | F25B 41/062 | 62/222 |
| 2007/0068178 | A1* | 3/2007 | Honma | F25B 9/008 | 62/160 |

FOREIGN PATENT DOCUMENTS

| | | | | |
|---|---|---|---|---|
| JP | 08-261576 | A | | 10/1996 |
| JP | 09-068356 | A | | 3/1997 |
| JP | H11173698 | A | * | 7/1999 |
| JP | 2000-356420 | A | | 12/2000 |
| JP | 2001-141322 | A | | 5/2001 |
| JP | 2009-222356 | A | | 10/2009 |
| JP | 2009222356 | A | * | 10/2009 |
| JP | 2009281631 | A | * | 10/2009 |
| JP | WO2009133640 | A1 | * | 11/2009 |
| WO | 2010/049998 | A1 | | 5/2010 |
| WO | 2011/064814 | A1 | | 6/2011 |

OTHER PUBLICATIONS

Shinichi et al., Air Conditioner, Nov. 5, 2009, WO2009133640A1, Whole Document.*

Yasuhiko et al., Heat Pump Unit, Dec. 3, 2009, JP2009281631A, Whole Document.*

Tetsuji et al., Refrigeration Cycle, Jul. 2, 1999, JPH11173698A, Whole Document.*

International Search Report of the International Searching Authority mailed Sep. 13, 2011 for the corresponding international application No. PCT/JP2011/003383 (and English translation).

Office Action issued Feb. 25, 2016 in the corresponding GB application No. 1319670.4.

* cited by examiner

AIR-CONDITIONING APPARATUS

CROSS REFERENCE TO RELATED APPLICATION

This application is a U.S. national stage application of International Application No. PCT/JP2011/003383 filed on Jun. 14, 2011, the disclosure of which is incorporated by reference.

TECHNICAL FIELD

The present invention relates to an air-conditioning apparatus used as, for example, a mufti-air-conditioning apparatus for buildings.

BACKGROUND ART

Among air-conditioning apparatuses, such as multi-air-conditioning apparatuses for buildings, the following type of air-conditioning apparatus is known. By circulating a refrigerant from an outdoor unit to a relaying unit and by circulating a heat medium, such as water, from the relaying unit to an indoor unit, transfer power of a heat medium, such as water, is reduced while circulating the heat medium in the indoor unit (for example, see Patent Literature 1).

The following type of air-conditioning apparatus is also known. A zeotropic refrigerant mixture is used, and a high-pressure side and a low-pressure side are connected to each other with a bypass pipe via a second decompressing device. The circulating composition of the zeotropic refrigerant mixture is calculated from a pressure signal and a temperature signal (for example, see Patent Literature 2).

A multi-air-conditioning apparatus that detects the composition of a zeotropic refrigerant mixture is also available (for example, see Patent Literature 3).

CITATION LIST

Patent Literature

Patent Literature 1: WO10/049998 (page 3, FIG. 1, and so on)

Patent Literature 2: Japanese Patent Application Laid-Open (JP-A) No. H08-75280 (page 5, FIG. 1)

Patent Literature 3: Japanese Patent Application Laid-Open JP-A) No. H09-68356 (page 7, FIG. 1)

SUMMARY OF INVENTION

Technical Problem

In an air-conditioning apparatus, such as that disclosed in Patent Literature 1, a refrigerant is circulated between an outdoor unit and a relaying unit, and a heat medium, such as water, is circulated between the relaying unit and an indoor unit, thereby performing heat exchange between a refrigerant and a heat medium, such as water, in the relaying unit. However, in Patent Literature 1, there is no description of a composition detecting circuit or control in the case of the use of a zeotropic refrigerant mixture as a refrigerant. Accordingly, there is no guarantee to implement an efficient operation if a zeotropic refrigerant mixture is used as a refrigerant.

In an air-conditioning apparatus, such as that disclosed in Patent Literature 2, a refrigerant constantly flows in a bypass pipe which connects a high-pressure side and a low-pressure side, and the refrigerant flowing through the bypass pipe does not contribute to a heating operation or a cooling operation, thereby making the operation inefficient.

In an air-conditioning apparatus, such as that disclosed in Patent Literature 3, the composition of a refrigerant can be detected if a multi-air-conditioning apparatus is utilized. However, as in Patent Literature 2, a refrigerant constantly flows in a bypass pipe which connects a high-pressure side and a low-pressure side, and the refrigerant flowing through the bypass pipe does not contribute to a heating operation or a cooling operation, thereby making the operation inefficient.

The present invention has been made in order to solve the above-described problems. Accordingly, it is an object of the present invention to obtain an air-conditioning apparatus that detects the composition of a refrigerant, depending on whether or not a refrigeration cycle is in a stable state, so as to improve energy efficiency when the refrigeration cycle is in a stable state.

Solution to Problem

An air-conditioning apparatus according to the present invention is an air-conditioning apparatus in which a refrigeration cycle is formed by connecting a compressor, a refrigerant flow channel switching device, a first heat exchanger, a first expansion device, and a second heat exchanger to one another with a refrigerant pipe and by causing a refrigerant that is a refrigerant mixture to circulate within the refrigerant pipe. The air-conditioning apparatus includes: a high/low pressure bypass pipe that connects a flow channel at a discharge side of the compressor and a flow channel at a suction side of the compressor; a second expansion device that is disposed in the high/low pressure bypass pipe and decompresses the refrigerant flowing through the high/low pressure bypass pipe; an inter-refrigerant heat exchanger that performs heat exchange between the refrigerant flowing on a front side of the second expansion device through the pipe and the refrigerant flowing on a behind side of the second expansion device through the pipe; a bypass-channel opening/closing device that is disposed in the high/low pressure bypass pipe and opens and closes the flow channel of the high/low pressure bypass pipe; and a controller having a function of calculating a composition ratio of the refrigerant mixture by using a low-pressure-side pressure of a refrigerant to be sucked into the compressor, a high-pressure-side temperature of the refrigerant at an inlet side of the second expansion device in the high/low pressure bypass pipe, and a low-pressure-side temperature of the refrigerant at an outlet side of the second expansion device in the high/low pressure bypass pipe and having a function of determining whether to open or close bypass-channel opening/closing device in accordance with an operating state.

Advantageous Effects of Invention

According to an air-conditioning apparatus of the present invention, the opening and closing of a bypass-channel opening/closing device is controlled depending on whether or not a refrigeration cycle is in a stable state so as to improve energy efficiency when the refrigeration cycle is in a stable state, thereby achieving energy saving.

DESCRIPTION OF EMBODIMENTS

Embodiment of the present invention will be described below with reference to the drawings.

Figure 1:
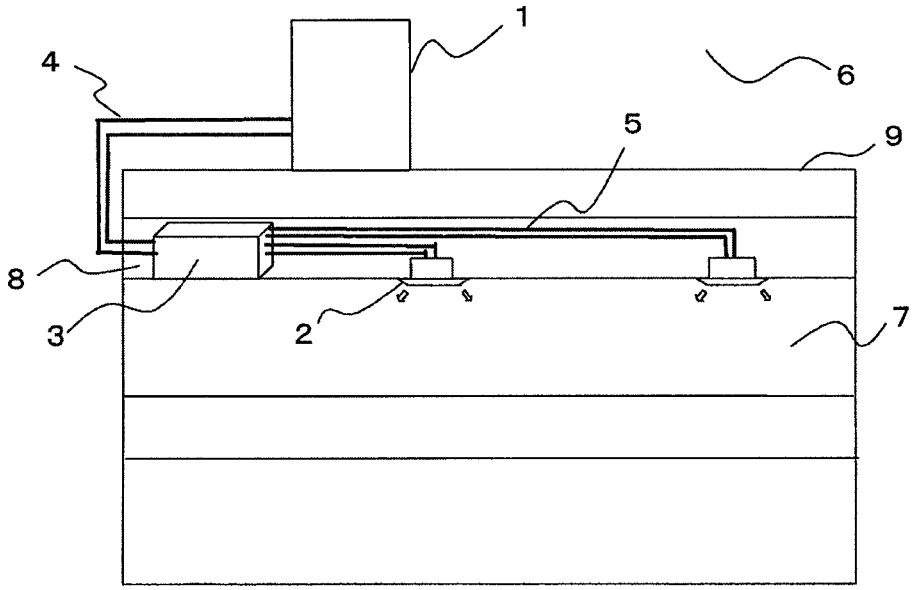
FIG. 1 is a schematic view illustrating an example in which an air-conditioning apparatus according to Embodiment of the present invention is installed.

FIG. 1 is a schematic view illustrating an example in which an air-conditioning apparatus according to Embodiment of the present invention is installed. An installation example of the air-conditioning apparatus will be described below with reference to FIG. 1. In this air-conditioning apparatus, by utilizing a refrigeration cycle (refrigerant circuit A and heat medium circuit B) in which refrigerants (a heat source side refrigerant and a heat medium) circulate, each indoor unit is capable of freely selecting a cooling mode or a heating mode as an operation mode. In the following drawings including FIG. 1, the correspondence between the sizes of components is not always the same as the actual correspondence.

In FIG. 1, the air-conditioning apparatus of Embodiment includes one outdoor unit 1, which is a heat source device, a plurality of indoor units 2, and a heat medium relay unit 3 interposed between the outdoor unit 1 and the indoor units 2. The heat medium relay unit 3 performs heat exchange between a heat source side refrigerant and a heat medium. The outdoor unit 1 and the heat medium relay unit 3 are connected to each other with refrigerant pipes 4 which cause a heat source side refrigerant to pass through. The heat medium relay unit 3 and the indoor units 2 are connected to each other with pipes (heat medium pipes) 5 which cause a heat medium to pass therethrough. Then, cooling energy or heating energy generated in the outdoor unit 1 is distributed over the indoor units 2 through the heat medium relay unit 3.

The outdoor unit 1 is generally installed in an outdoor space 6, which is a space outside a building 9 (for example, a rooftop), and supplies cooling energy or heating energy to the indoor units 2 via the heat medium relay unit 3. The indoor units 2 are installed at positions at which they can supply cooling air or heating air to an indoor space 7, which is a space inside the building 9 (for example, a living room), and supply cooling air or heating air to the indoor space 7, which is an air-conditioned space. The heat medium relay unit 3 is provided as a casing different from the outdoor unit 1 or the indoor units 2 and is configured such that they can be installed at a position different from the outdoor space 6 or the indoor space 7. The heat medium relay unit 3 is connected to the outdoor unit 1 and the indoor units 2 with the refrigerant pipes 4 and the pipes 5, respectively, and transmits cooling energy or heating energy supplied from the outdoor unit 1 to the indoor units 2.

As shown in FIG. 1, in the air-conditioning apparatus according to Embodiment, the outdoor unit 1 and the heat medium relay unit 3 are connected to each other by using the two refrigerant pipes 4, and the heat medium relay unit 3 and each of the indoor units 2 are connected to each other by using the two pipes 5. In this manner, in the air-conditioning apparatus according to Embodiment, the units (the outdoor unit 1 and the heat medium relay unit 3) are connected to each other by using two pipes (the refrigerant pipes 4) and the units (each of the indoor units 2 and the heat medium relay unit 3) are connected to each other by using two pipes (the pipes 5), thereby facilitating the construction of the air-conditioning apparatus.

In FIG. 1, there is shown a state, by way of example, in which the heat medium relay unit 3 is installed in a space, for example, above a ceiling (hereinafter simply referred to as a "space 8"), which is different from the indoor space 7, though the space 8 is positioned within the building 9. Alternatively, the heat medium relay unit 3 may be installed in a common use space, such as a space in which an elevator is installed. In FIG. 1, a case in which the indoor units 2 are of a ceiling cassette type is shown by way of example. However, the indoor units 2 are not restricted to this type, and may be any type, such as a ceiling concealed type or a ceiling suspended type, as long as they can blow heating air or cooling air to the indoor space 7 directly or through a duct.

In FIG. 1, a case in which the outdoor unit 1 is installed in the outdoor space 6 is shown by way of example. However, this is only an example, and the outdoor unit 1 may be installed in a surrounded space, such as a machine room with a ventilation opening, or may be installed within the building 9 as long as waste heat can be exhausted outside the building 9 by using an exhaustion duct. Alternatively, a water-cooled outdoor unit 1 may be used and installed within the building 9. Even if the outdoor unit 1 is installed in such places, problems do not occur particularly.

The heat medium relay unit 3 may be installed near the outdoor unit 1. However, attention has to be paid that, if the distances from the heat medium relay unit 3 to the indoor units 2 are too long, conveyance power for a heat medium becomes considerably large, thereby reducing the power-saving effect. Moreover, the numbers of indoor units 1, outdoor units 2, and heat medium relay units 3 connected to each other are not restricted to those shown in FIG. 1, and may be determined depending on the building 9 in which the air-conditioning apparatus according to Embodiment is installed.

Figure 2:
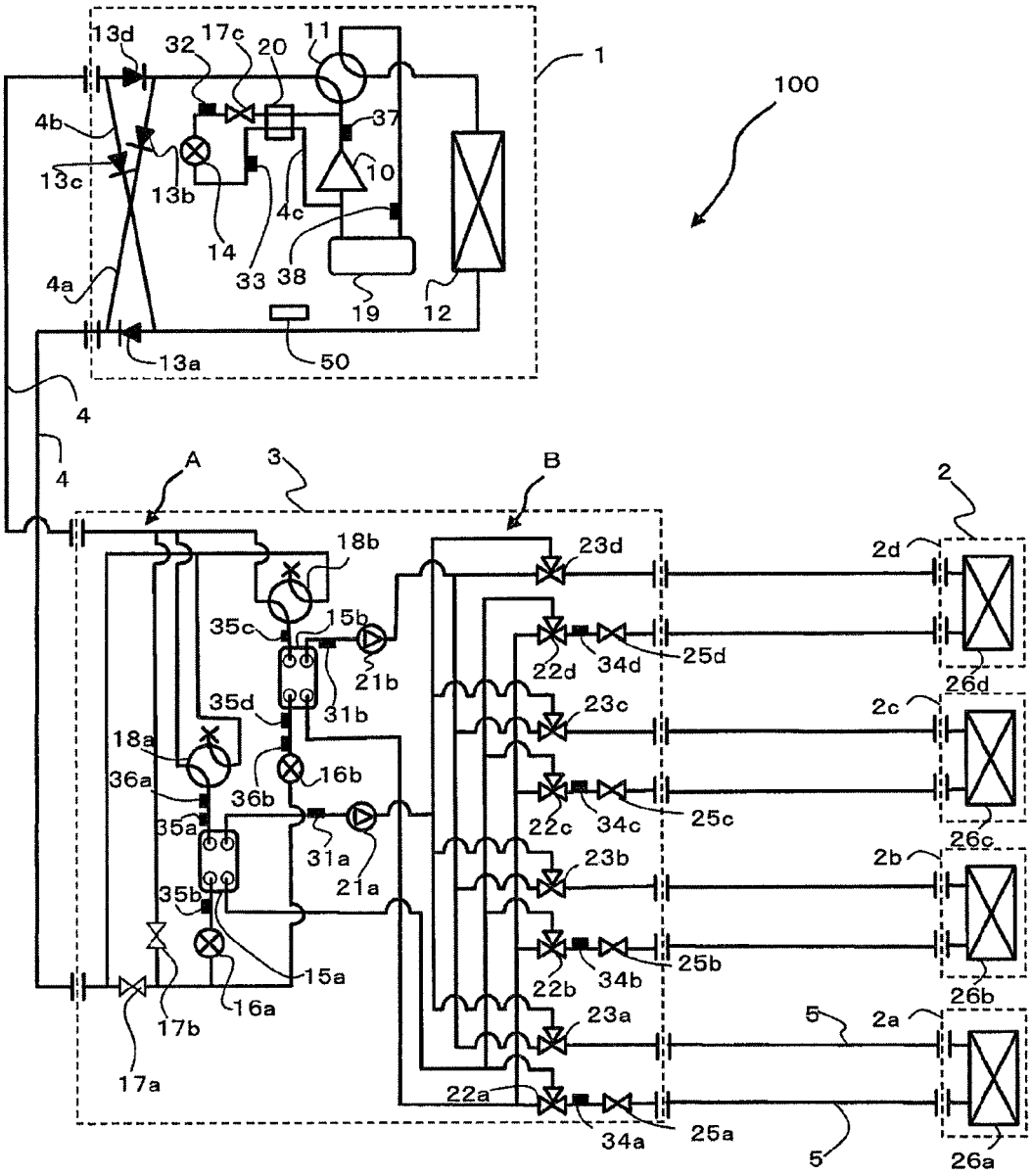
FIG. 2 is a schematic circuit diagram illustrating an example of a circuit configuration of the air-conditioning apparatus according to Embodiment of the present invention.

FIG. 2 is a schematic circuit diagram illustrating an example of a circuit configuration of the air-conditioning apparatus according to Embodiment (hereinafter referred to as an "air-conditioning apparatus 100"). A detailed configuration of the air-conditioning apparatus 100 will be discussed below with reference to FIG. 2. As shown in FIG. 2, the outdoor unit 1 and the heat medium relay unit 3 are connected to each other by using the refrigerant pipes 4 via intermediate heat exchangers 15*a* and 15*b* included in the heat medium relay unit 3. The heat medium relay unit 3 and each of the indoor units 2 are also connected to each other by using the pipes 5 via the intermediate heat exchangers 15*a* and 15*b*. Details of the refrigerant pipes 4 and the pipes 5 will be given later.

{Configuration of Air-Conditioning Apparatus 100}

[Outdoor Unit (First Unit) 1]

In the outdoor unit 1, a compressor 10, a first refrigerant flow channel switching device 11, such as a four-way valve, a heat-source-side heat exchanger (first heat exchanger) 12, and an accumulator 19 are mounted such that they are connected in series with one another by the refrigerant pipes 4. The outdoor unit 1 also includes a first connecting pipe 4*a*, a second connecting pipe 4*b*, and check valves 13*a*, 13*b*, 13*c*, and 13*d*. By providing the first and second connecting pipes 4*a* and 4*b* and the check valves 13*a* through 13*d*, the flow of a heat source side refrigerant which flows into the heat medium relay unit 3 can be set in a fixed direction regardless of the operation requested by the indoor units 2.

In the outdoor unit 1, a high/low pressure bypass pipe 4*c*, an expansion device (second expansion device) 14, an inter-refrigerant heat exchanger 20, a high-pressure-side refrigerant temperature detector 32, a low-pressure-side refrigerant temperature detector 33, a high-pressure-side refrigerant pressure detector 37, a low-pressure-side refrigerant pressure detector 38, and an opening/closing device (bypass-channel opening/closing device) 17*c* are also mounted. The high/low-pressure bypass pipe 4*c* connects a flow channel at a discharge side and a flow channel at a suction side of the compressor 10. The expansion device 14 is installed in the high/low-pressure bypass pipe 4*c*. The inter-refrigerant heat exchanger 20 is installed in the high/low pressure bypass pipe 4*c* and performs heat exchange at the front and behind sides of the expansion device 14 in the high/low pressure bypass pipe 4*c*. The high-pressure-side refrigerant temperature detector 32 is installed at the inlet side of the expansion device 14, while the low-pressure-side refrigerant temperature detector 33 is installed at the outlet side of the expansion device 14. The high-pressure-side refrigerant pressure detector 37 is capable of detecting a high-pressure-side pressure of the compressor 10, while the low-pressure-side refrigerant pressure detector 38 is capable of detecting a low-pressure-side pressure of the compressor 10. The opening/closing (bypass-channel opening/closing device) 17*c* is installed at the inlet side of the expansion device 14 and in the flow channel between the inter-refrigerant heat exchanger 20 and the expansion device 14.

That is, the discharge side of the compressor 10, the primary side of the inter-refrigerant heat exchanger 20 (the flow channel side of the compressor 10 from which a refrigerant is discharged), the opening/closing device 17*c*, the expansion device 14, the secondary side of the inter-refrigerant heat exchanger 20 (the flow channel side of the compressor 10 into which a refrigerant sucks), and the suction side of the compressor 10 are connected to each other with the high/low pressure bypass pipe 4*c*. The high/low pressure bypass pipe 4*c*, the expansion device 14, the opening/closing device 17*c*, and the inter-refrigerant heat exchanger 20 will be discussed in detail later. As the high-pressure-side refrigerant pressure detector 37 and the low-pressure-side refrigerant pressure detector 38, a strain gauge type or a semiconductor type, for example, is used, and as the high-pressure-side refrigerant temperature detector 32 and the low-pressure-side refrigerant temperature detector 33, a thermistor type, for example, is used. In the following description, the high-refrigerant pressure detector 37 and the low-pressure-side refrigerant pressure detector 38 will be referred to as a "high pressure sensor 37" and a "low pressure sensor 38", respectively, and the high-pressure-side refrigerant temperature detector 32 and the low-pressure-side refrigerant temperature detector 33 will be referred to as a "high temperature sensor 32" and a "low temperature sensor 33", respectively.

The compressor 10 sucks a heat source side refrigerant and compresses it to a high-temperature high-pressure state. The compressor 10 may be constructed as, for example, an inverter compressor in which the capacity can be controlled. The first refrigerant flow channel switching device 11 switches between the flow of a heat source side refrigerant used during a heating operation (during a heating only operation mode and a heating main operation mode) and the flow of a heat source side refrigerant used during a cooling operation (during a cooling only operation mode and a cooling main operation mode).

The heat-source-side heat exchanger 12 functions as an evaporator during a heating operation and functions as a condenser (or a radiator) during a cooling operation. The heat-source-side heat exchanger 12 performs heat exchange between air supplied from an air-sending device (not shown), such as a fan, and a heat source side refrigerant, thereby evaporating and gasifying or condensing and liquefying the heat source side refrigerant. The accumulator 19 is provided at the suction side of the compressor 10, and accumulates a surplus refrigerant produced by a difference between a heating operation and a cooling operation, or a surplus refrigerant produced by a change during the transition of the operation.

The check valve 13*d* is provided in the refrigerant pipe 4 between the heat medium relay unit 3 and the first refrigerant flow channel switching device 11, and allows a heat source side refrigerant to flow only in a predetermined direction (direction from the heat medium relay unit 3 to the outdoor unit 1). The check valve 13*a* is provided in the refrigerant pipe 4 between the heat-source-side heat exchanger 12 and the heat medium relay unit 3, and allows a heat source side refrigerant to flow only in a predetermined direction (direction from the outdoor unit 1 to the heat medium relay unit 3). The check valve 13*b* is provided in the first connecting pipe 4*a* and causes a heat source side refrigerant discharged from the compressor 10 to circulate in the heat medium relay unit 3 during a heating operation. The check valve 13*c* is provided in the second connecting pipe 4*b* and causes a heat source side refrigerant returned from the heat medium relay unit 3 to circulate in the suction side of the compressor 10 during a heating operation.

In the outdoor unit 1, the first connecting pipe 4*a* connects a portion of the refrigerant pipe 4 positioned between the first refrigerant flow channel switching device 11 and the check valve 13*d* and a portion of the refrigerant pipe 4 positioned between the check valve 13*a* and the heat medium relay unit 3. In the outdoor unit 1, the second connecting pipe 4*b* connects a portion of the refrigerant pipe 4 positioned between the check valve 13*d* and the heat medium relay unit 3 and a portion of the refrigerant pipe 4 positioned between the heat-source-side heat exchanger 12 and the check valve 13*a*. In FIG. 2, an example in which the first connecting pipe 4*a*, the second connecting pipe 4*b*, and the check valves 13*a*, 13*b*, 13*c*, and 13*d* are disposed is shown. However, without being limited, they are examples only, and these elements do not have to be necessarily provided.

[Indoor Unit (Second Unit) 2]

In each of the indoor units 2, a use side heat exchanger (second heat exchanger) 26 is mounted. This use side heat exchanger 26 is connected to a heat medium flow control device 25 and a second heat-medium flow channel switching device 23 of the heat medium relay unit 3 by using the pipes 5. This use side heat exchanger 26 performs heat exchange between air supplied from an air-sending device (not shown), such as a fan, and a heat medium and generates heating air or cooling air to be supplied to the indoor space 7.

FIG. 2 shows a case in which four indoor units 2 are connected to the heat medium relay unit 3 by way of example. The indoor units 2 are shown as indoor units 2*a*, 2*b*, 2*c*, and 2*d* from the bottom side of the plane of the drawing. The use side heat exchangers 26 are also shown as use side heat exchangers 26*a*, 26*b*, 26*c*, and 26*d*, respectively, from the bottom side of the plane of the drawing, in accordance with the indoor units 2*a* through 2*d*. As in FIGS. 1 and 2, the number of indoor units 2 to be connected is not restricted to four indoor units shown in FIG. 2.

[Heat Medium Relay Unit (Second Unit) 3]

In the heat medium relay unit 3, two intermediate heat exchangers (second heat exchangers) 15, two expansion devices (first expansion devices) 16, two opening/closing devices 17, two second refrigerant flow channel switching devices 18, two pumps 21, four first heat-medium flow channel switching devices 22, four second heat-medium flow channel switching devices 23, and four heat medium flow control devices 25 are mounted.

The two intermediate heat exchangers 15 (intermediate heat exchangers 15*a* and 15*b*) function as condensers (radiators) or evaporators, and perform heat exchange between a heat source side refrigerant and a heat medium and transmit cooling energy or heating energy which is generated in the outdoor unit 1 and which is stored in the heat source side refrigerant to the heat medium. The intermediate heat exchanger 15*a* is provided between the expansion device 16*a* and the second refrigerant flow channel switching device 18*a* in the refrigerant circuit A, and serves to cool a heat medium during a cooling and heating mixed operation mode. The intermediate heat exchanger 15*b* is provided between the expansion device 16*b* and the second refrigerant flow channel switching device 18*b* in the refrigerant circuit A, and serves to heat a heat medium during a cooling and heating mixed operation mode.

The two expansion devices 16 (expansion devices 16*a* and 16*b*), which function as pressure reducing valves or expansion valves, decompress and expand a heat source side refrigerant. The expansion device 16*a* is provided on the upstream side of the intermediate heat exchanger 15*a* in the flow of a heat source side refrigerant at the time of a cooling operation. The expansion device 16*b* is provided on the upstream side of the intermediate heat exchanger 15*b* in the flow of a heat source side refrigerant at the time of a cooling operation. As the two expansion devices 16, expansion valves in which the opening degree is variable, such as electronic expansion valves, may be used.

The two opening/closing devices 17 (opening/closing devices 17*a* and 17*b*) are constituted by two-way valves, and open and close the refrigerant pipes 4. The opening/closing device 17*a* is provided at the inlet side of the refrigerant pipe 4 into which a heat source side refrigerant is input. The opening/closing device 17*b* is provided in a pipe which connects the inlet side and the outlet side of the refrigerant pipe 4 into and from which a heat source side refrigerant is input and output.

The two second refrigerant flow channel switching devices 18 (second refrigerant flow channel switching devices 18*a* and 18*b*) are constituted by, for example, four-way valves, and switch the flow of a heat source side refrigerant in accordance with the operation mode. The second refrigerant flow channel switching device 18*a* is provided on the downstream side of the intermediate heat exchanger 15*a* in the flow of a heat source side refrigerant at the time of a cooling operation. The second refrigerant flow channel switching device 18*b* is provided on the downstream side of the intermediate heat exchanger 15*b* in the flow of a heat source side refrigerant in the cooling only operation mode.

The two pumps 21 (pumps 21*a* and 21*b*) serve to circulate a heat medium which passes through the pipes 5. The pump 21*a* is provided in the pipe 5 between the intermediate heat exchanger 15*a* and the second heat-medium flow channel switching device 23. The pump 21*b* is provided in the pipe 5 between the intermediate heat exchanger 15*b* and the second heat-medium flow channel switching device 23. As the two pumps 21, pumps in which the capacity can be controlled may be used, and the flow rate of the pumps 21 may be set to be adjustable depending on the load in the indoor units 2.

The four first heat-medium flow channel switching devices 22 (first heat-medium flow channel switching devices 22*a* through 22*d*) are constituted by, for example, three-way valves, and switch the flow channel of a heat medium. The same number (four in this case) of first heat-medium flow channel switching devices 22 as the number of indoor units 2 is provided. In each of the first heat-medium flow channel switching devices 22, one of the three ports is connected to the intermediate heat exchanger 15*a*, one of the three ports is connected to the intermediate heat exchanger 15*b*, and one of the three ports is connected to the heat medium flow control device 25. Each of the first heat-medium flow channel switching devices 22 is provided at the outlet side of the heat medium flow channel connected to the associated use side heat exchanger 26. The first heat-medium flow channel switching devices 22 are shown as the first heat-medium flow channel switching devices 22*a*, 22*b*, 22*c*, and 22*d* from the bottom side of the plane of the drawing, in accordance with the indoor units 2. The switching of the heat medium flow channel includes, not only complete switching from one side to the other side, but also partial switching from one side to the other side.

The four second heat-medium flow channel switching devices 23 (second heat-medium flow channel switching devices 23*a* through 23*d*) are constituted by, for example, three-way valves, and switch the flow channel of a heat medium. The same number (four in this case) of second heat-medium flaw channel switching devices 23 as the number of indoor units 2 is provided. In each of the second heat-medium flow channel switching devices 23, one of the three ports is connected to the intermediate heat exchanger 15*a*, one of the three ports is connected to the intermediate heat exchanger 15*b*, and one of the three ports is connected to the use side heat exchanger 26. Each of the second heat-medium flow channel switching devices 23 is provided at the inlet side of the heat medium flow channel connected to the associated use side heat exchanger 26. The second heat-medium flow channel switching devices 23 are shown as the second heat-medium flow channel switching devices 23*a*, 23*b*, 23*c*, and 23*d* from the bottom side of the plane of the drawing, in accordance with the indoor units 2. The switching of the heat medium flow channel includes, not only complete switching from one side to the other side, but also partial switching from one side to the other side.

The four heat medium flow control devices 25 (heat medium flow control devices 25*a* through 25*d*) are constituted by, for example, two-way valves in which the opening area can be controlled, and control the flow rate of a heat medium flowing through the pipes 5. The same number (four in this case) of heat medium flow control devices 25 as the number of indoor units 2 is provided. In each of the heat medium flow control devices 25, one of the two ports is connected to the use side heat exchanger 26, and the other one of the two ports is connected to the first heat-medium flow channel switching device 22. Each of the heat medium flow control devices 25 is provided at the outlet side of the heat medium flow channel connected to the associated use side heat exchanger 26. That is, each of the heat medium flow control devices 25 controls the amount of heat medium flowing into the associated indoor unit 2 on the basis of the temperatures of a heat medium flowing into and out of the indoor unit 2, thereby making it possible to provide the optimal amount of heat medium to the indoor unit 2 in accordance with an indoor load.

The heat medium flow control devices 25 are shown as the heat medium flow control devices 25*a*, 25*b*, 25*c*, and 25*d* from the bottom side of the plane of the drawing, in accordance with the indoor units 2. Each of the heat medium flow control devices 25 may be provided at the inlet side of the heat medium flow channel connected to the associated use side heat exchanger 26. Moreover, each of the heat medium flow control devices 25 may be provided at the inlet side of the heat medium flow channel connected to the associated use side heat exchanger 26 between the second heat-medium flow channel switching device 23 and the use side heat exchanger 26. Additionally, if a load is not necessary in the indoor unit 2, for example, when the indoor unit 2 is turned OFF or when the thermostat is turned OFF, the heat medium flow control device 25 may be set in the full closed position, thereby making it possible to stop supplying a heat medium to the indoor unit 2.

In the heat medium relay unit 3, various detection means (two first temperature sensors 31, four second temperature sensors 34, four third temperature sensors 35, and two pressure sensors 36) are provided. Items of information (temperature information and pressure information) obtained in these detection means are supplied to the controller 50 that centrally controls the operation of the air-conditioning apparatus 100, and are utilized for controlling the driving frequency of the compressor 10, the rotation speed of an air-sending device (not shown), the switching of the first refrigerant flow channel switching device 11, the driving frequency of the pumps 21, the switching of the second refrigerant flow channel switching devices 18, the switching of the heat medium flow channel, the adjustment of the flow rate of a heat medium in the indoor units 2, and so on.

Each of the two first temperature sensors 31 (first temperature sensors 31*a* and 31*b*) detects the temperature of a heat medium flowing out of the intermediate heat exchanger 15 that is, the temperature of a heat medium at the outlet of the intermediate heat exchanger 15. The first temperature sensors 31 may be constituted by, for example, thermistors. The first temperature sensor 31*a* is provided in the pipe 5 at the inlet side of the pump 21*a*. The first temperature sensor 31*b* is provided in the pipe 5 at the inlet side of the pump 21*b*.

Each of the four second temperature sensors 34 (second temperature sensors 34*a* through 34*d*) is provided between the associated first heat-medium flow channel switching device 22 and the associated heat medium flow control device 25, and detects the temperature of a heat medium flowing out of the use side heat exchangers 26. The second temperature sensors 34 may be constituted by, for example, thermistors. The same number (four in this case) of second temperature sensors 34 as the number of indoor units 2 is provided. The second temperature sensors 34 are shown as the second temperature sensors 34*a*, 34*b*, 34*c*, and 34*d* from the bottom side of the plane of the drawing, in accordance with the indoor units 2. Each of the four second temperature sensors 34 may be provided in the flow channel between the associated heat medium flow control device 25 and the associated use side heat exchanger 26.

The four third temperature sensors 35 (third temperature sensors 35*a* through 35*d*) are provided at the inlet side or the outlet side of the intermediate heat exchangers 15 into and from which a heat source side refrigerant is input and output, and detect the temperature of a heat source side refrigerant flowing into or out of the intermediate heat exchangers 15. The third temperature sensors 35 may be constituted by, for example, thermistors. The third temperature sensor 35*a* is provided between the intermediate heat exchanger 15*a* and the second refrigerant flow channel switching device 18*a*. The third temperature sensor 35*b* is provided between the intermediate heat exchanger 15*a* and the expansion device 16*a*. The third temperature sensor 35*c* is provided between the intermediate heat exchanger 15*b* and the second refrigerant flow channel switching device 18*b*. The third temperature sensor 35*d* is provided between the intermediate heat exchanger 15*b* and the expansion device 16*b*.

The pressure sensor 36*b* is provided between the intermediate heat exchanger 15*b* and the expansion device 16*b*, in a manner similar to the installation position of the third temperature sensor 35*d*. The pressure sensor 36*b* serves to detect the pressure of a heat source side refrigerant flowing between the intermediate heat exchanger 15*b* and the expansion device 16*b*. The pressure sensor 36*a* is provided between the intermediate heat exchanger 15*a* and the second refrigerant flow channel switching device 18*a*, in a manner similar to the installation position of the third temperature sensor 35*a*. The pressure sensor 36*a* serves to detect the pressure of a heat source side refrigerant flowing between the intermediate heat exchanger 15*a* and the second refrigerant flow channel switching device 18*a*.

The controller 50 is constituted by a microcomputer and so on, and controls, on the basis of detection information obtained by various detection means or instructions from a remote controller, the driving frequency of the compressor 10, the rotation speed of an air-sending device (including ON/OFF), the switching of the first refrigerant flow channel switching device 11, the driving of the pumps 21, the opening degree of the expansion valves 16, the opening/closing of the opening/closing devices 17, the switching of the second refrigerant flow channel switching devices 18, the switching of the first heat-medium flow channel switching devices 22, the switching of the second heat-medium flow channel switching devices 23, the driving of the heat medium flow control device 25, and so on, and then implements individual operation modes, which will be described below. Although the state in which the controller 50 is provided in the outdoor unit 1 is shown by way of example, the installation position of the controller 50 is not particularly restricted.

The pipes 5 through which a heat medium passes are constituted by pipes 5 connected to the intermediate heat exchangers 15*a* and pipes 5 connected to the intermediate heat exchangers 15*b*. The pipes 5 branch off (in this case, in four directions) in accordance with the number of indoor units 2 connected to the heat medium relay unit 3. The pipes 5 join at the first heat-medium flow channel switching devices 22 and the second heat-medium flow channel switching devices 23. By controlling the first heat-medium flow channel switching devices 22 and the second heat-medium flow channel switching devices 23, a determination is made as to whether a heat medium from the intermediate heat exchanger 15*a* or from the intermediate heat exchanger 15*b* will flow into the use side heat exchangers 26.

In the air-conditioning apparatus 100, the compressor 10, the first refrigerant flow channel switching device 11, the heat-source-side heat exchanger 12, the opening/closing devices 17, the second refrigerant flow channel switching devices 18, the refrigerant flow channel of the intermediate heat exchangers 15, the expansion devices 16, and the accumulator 19 are connected to each other by using the refrigerant pipes 4, thereby forming the refrigerant circuit A. The heat medium flow channel of the intermediate heat exchangers 15, the pumps 21, the first heat-medium flow channel switching devices 22, the heat medium flow control devices 25, the use side heat exchangers 26, and the second heat-medium flow channel switching devices 23 are connected to one another by using the pipes 5, thereby forming the heat medium circuit B. That is, the plurality of use side heat exchangers 26 are connected in parallel with each of the intermediate heat exchangers 15, thereby allowing the heat medium circuit B to have a plurality of channels.

In the air-conditioning apparatus 100, the outdoor unit 1 and the heat medium relay unit 3 are connected to each other via the intermediate heat exchangers 15*a* and 15*b* provided in the heat medium relay unit 3, and the heat medium relay unit 3 and the indoor units 2 are also connected to each other via the intermediate heat exchangers 15*a* and 15*b*. That is, in the air-conditioning apparatus 100, heat exchange between a heat source side refrigerant which circulates within the refrigerant circuit A and a heat medium which circulates within the heat medium circuit B is performed in the intermediate heat exchangers 15*a* and 15*b*.

{Refrigerant Used in Air-Conditioning Apparatus 100}

A refrigerant used in the air-conditioning apparatus 100, that is, a heat source side refrigerant which circulates within the refrigerant circuit A, will be discussed below. In the air-conditioning apparatus 100, a refrigerant mixture of tetrafluoropropene, such as HFO-1234yf or HFO-1234ze, expressed by a chemical formula of $C_3H_2F_4$ and difluoroethane (R32) expressed by a chemical formula of $CH_2F_2$ is charged into the refrigerant pipes 4 and is circulated therein.

Tetrafluoropropene, which has a double bond in the chemical formula and is easily dissolved in air, is an environmentally friendly refrigerant having a small global warming potential (GWP) (4 through 6). On the other hand, however, the density of tetrafluoropropene is smaller than that of an existing refrigerant, such as R410A. Accordingly, if tetrafluoropropene is singly used as a refrigerant, a very large compressor is required in order to have a large heating or cooling capacity, and also, thick refrigerant pipes are required in order to suppress an increase in the pressure drop in the pipes. As a result, the cost is increased.

In contrast, the refrigerant characteristics of R32 are similar to those of an existing refrigerant, such as R410A. Accordingly, R32 is relatively easy to use without the need of making much change to an apparatus itself. On the other hand, GWP of R32 is 675, which is smaller than that of R410A, that is, 2088, however, it may be still too large in terms of environmental protection if R32 is singly used.

Then, in the air-conditioning apparatus 100, a refrigerant mixture in which R32 is mixed with tetrafluoropropene is used. By the use of such a refrigerant mixture, it is possible to improve refrigerant characteristics while suppressing GWP and to obtain an environmentally friendly, efficient air-conditioning apparatus. In this case, the mixing ratio of tetrafluoropropene to R32 may be, for example, 70:30 in terms of mass percentage ratio. However, the mixing ratio is not restricted to 70:30. A refrigerant other than tetrafluoropropene and R32 may be mixed into the refrigerant mixture.

Figure 3:
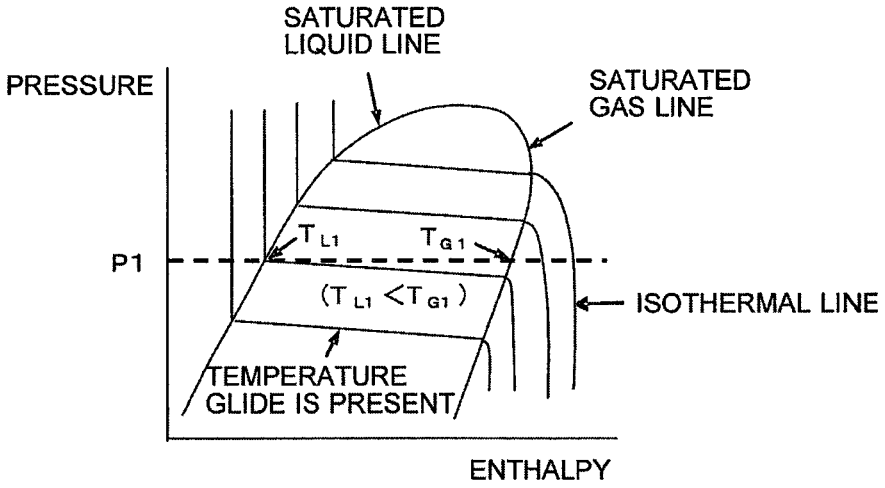
FIG. 3 is a ph diagram illustrating a phase transition of a refrigerant mixture used in the air-conditioning apparatus according to Embodiment of the present invention.

FIG. 3 is a ph diagram (pressure (vertical axis)-enthalpy (horizontal axis) diagram) illustrating a phase transition of a refrigerant mixture used in the air-conditioning apparatus 100. The characteristics of the refrigerant mixture used in the air-conditioning apparatus 100 will be discussed below with reference to FIG. 3. In FIG. 3, a refrigerant mixture of HFO-1234yf, which is one type of tetrafluoropropene, and R32, will be discussed as an example.

The boiling point of HFO-1234yf is −29 degrees C., and the boiling point of R32 is −53.2 degrees C. That is, the refrigerant mixture used in the air-conditioning apparatus 100 is a zeotropic refrigerant mixture in which refrigerants having different boiling points are mixed. For example, due to the presence of a reservoir, such as the accumulator 19, in the refrigerant circuit A, the composition of a refrigerant mixture including a plurality of components which is circulating within the circuit (hereinafter the composition of a refrigerant mixture circulating within the circuit will be referred to as a "circulating composition") is not fixed to the initial mixing ratio, but is changed.

Since the boiling points of individual components of a zeotropic refrigerant are different, the saturated liquid temperature and the saturated gas temperature under the same pressure are different. For example, as shown in FIG. 3, the saturated liquid temperature $T_{L1}$ and the saturated gas temperature $T_{G1}$ with respect to the pressure P1 are not equal to each other, but the saturated gas temperature $T_{G1}$ is higher than the saturated liquid temperature $T_{L1}$ ($T_{L1}<T_{G1}$). Because of this, isothermal lines in a two-phase area of the ph diagram in FIG. 3 are tilted (have a glide).

When the composition of the refrigerant mixture is changed, the ph diagram is also changed, and the glide of an isothermal line is also changed. For example, if the ratio of HFO-1234yf to R32 in terms of mass percentage is 70:30, the temperature at the high-pressure side of the glide is about 5.0 degrees C. and the temperature at the low-pressure side of the glide is about 7 degrees C. if the ratio is 50:50, the temperature at the high-pressure side of the glide is about 2.3 degrees C. and the temperature at the low-pressure side of the glide is about 2.8 degrees C. Accordingly, for determining a correct saturated liquid temperature and a correct saturated gas temperature under the pressure within the refrigerant circuit A, it is necessary to detect the circulating composition of a refrigerant circulating within the refrigerant circuit A.

In the air-conditioning apparatus 100, therefore, a circulating-composition detecting circuit including the bypass expansion device 14, the opening/closing device 17, and the inter-refrigerant heat exchanger 20 is provided in the high/low pressure bypass pipe 4*c*. Then, the air-conditioning apparatus 100 detects the circulating composition of a refrigerant circulating within the refrigerant circuit A on the basis of temperatures detected by the high temperature sensor 32 and the low temperature sensor 33 and pressures detected by the high pressure sensor 37 and the low pressure sensor 38. The detection of the circulating composition of a refrigerant is performed by the controller 50.

Figure 4:
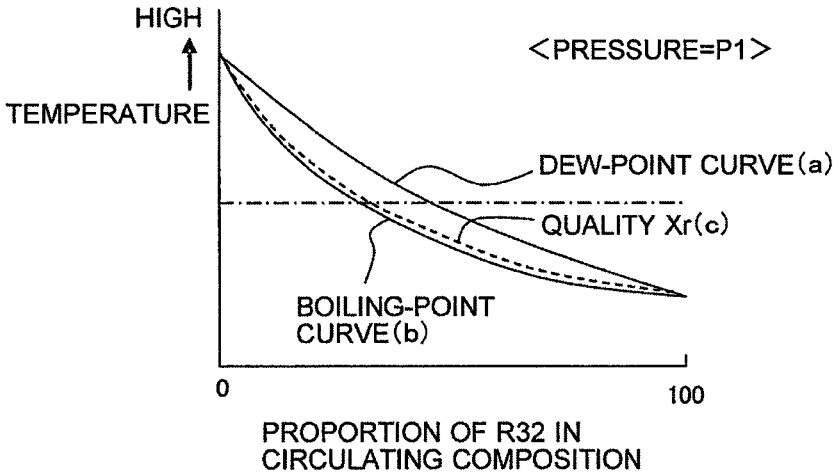
FIG. 4 is a gas-liquid equilibrium diagram of a two-component refrigerant mixture with respect to pressure P1 shown in FIG. 4.
Figure 5:
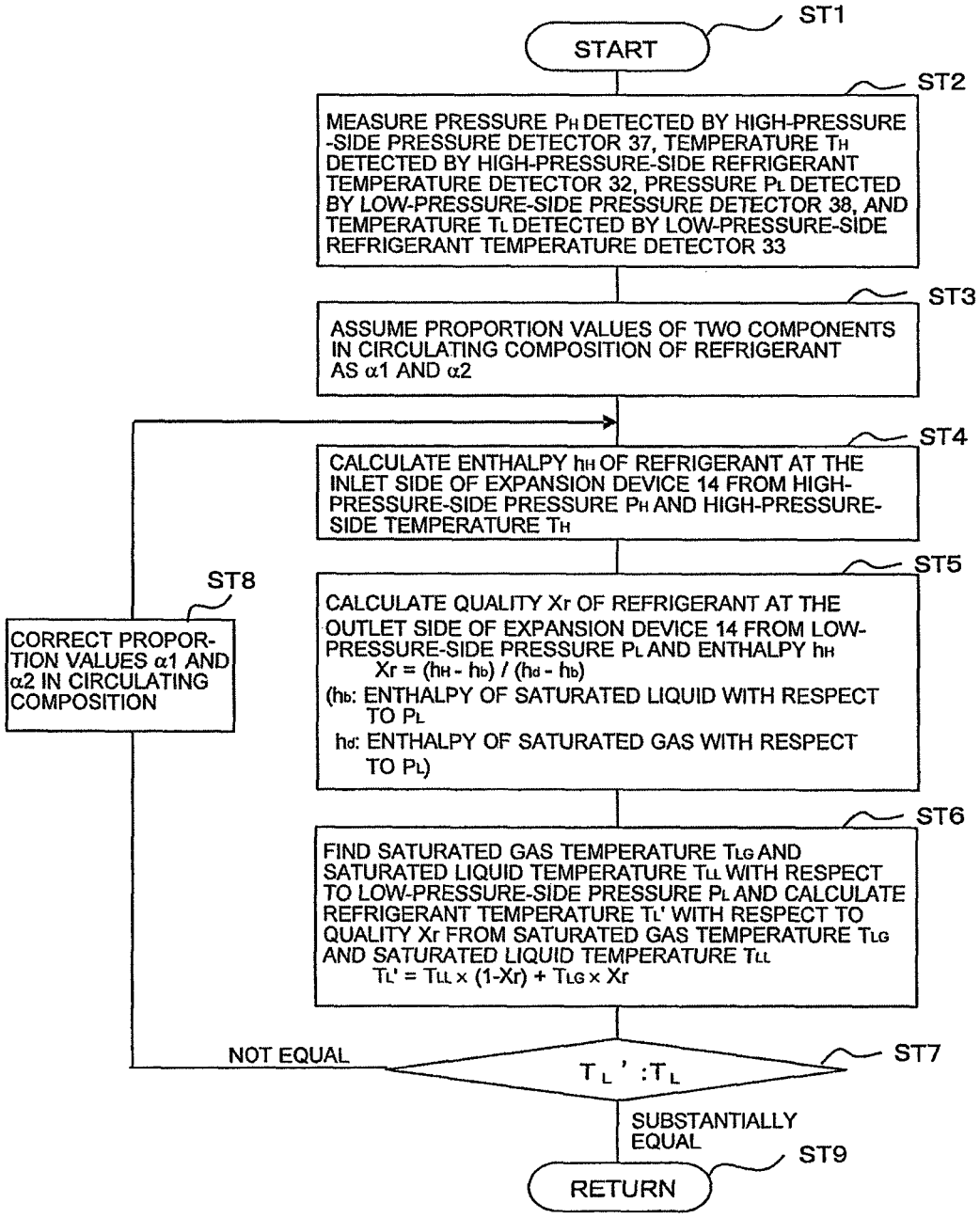
FIG. 5 is a flowchart illustrating a flow of a processing for detecting the circulating composition executed by a controller.
Figure 6:
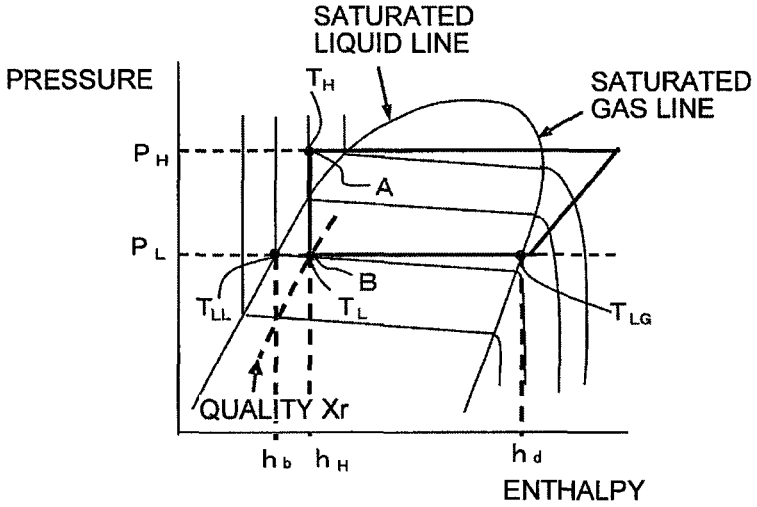
FIG. 6 is a ph diagram illustrating another phase of a refrigerant mixture used in the air-conditioning apparatus according to Embodiment of the present invention.
Figure 13:
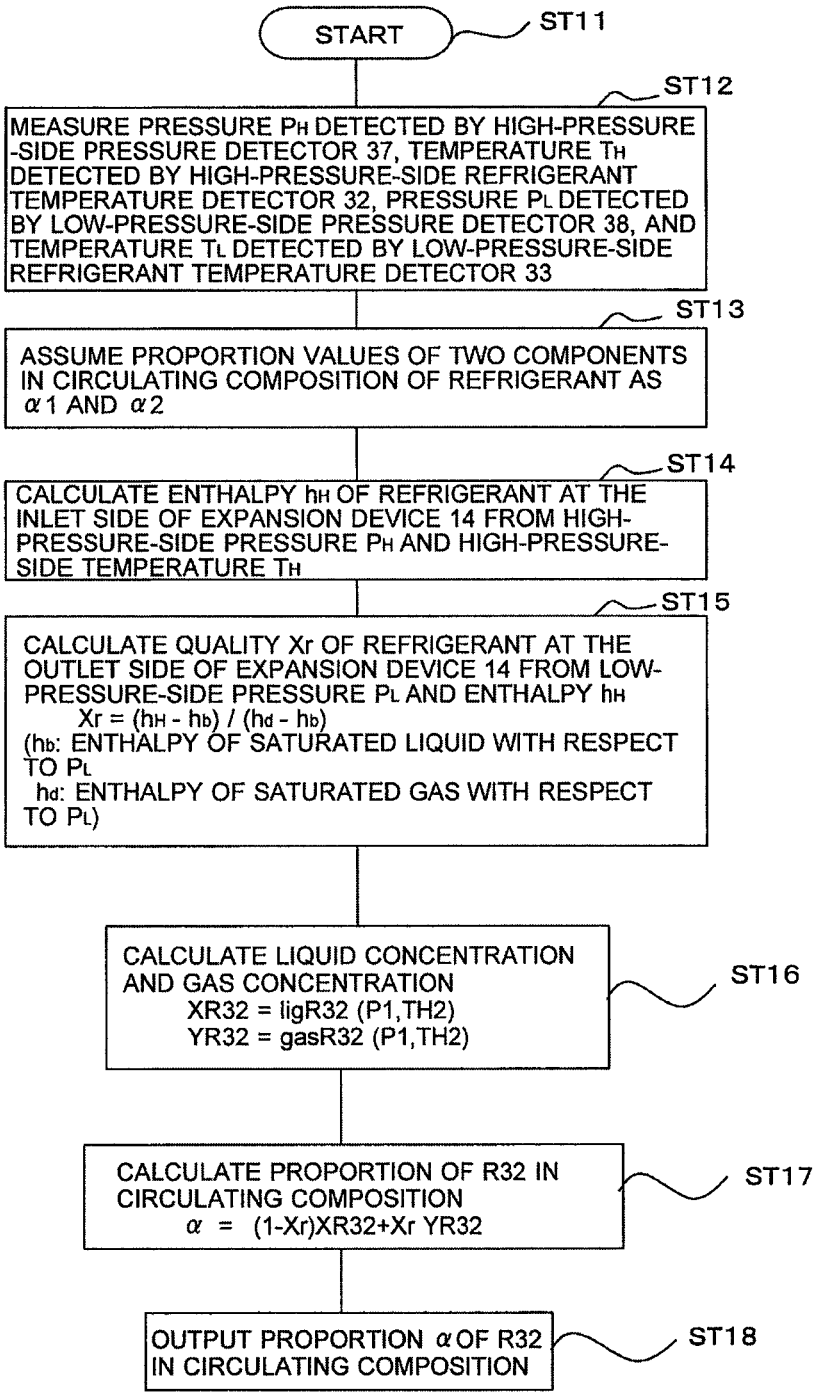
FIG. 13 is a flowchart illustrating a flow of another processing for detecting the circulating composition of a refrigerant executed by the controller.
Figure 14:
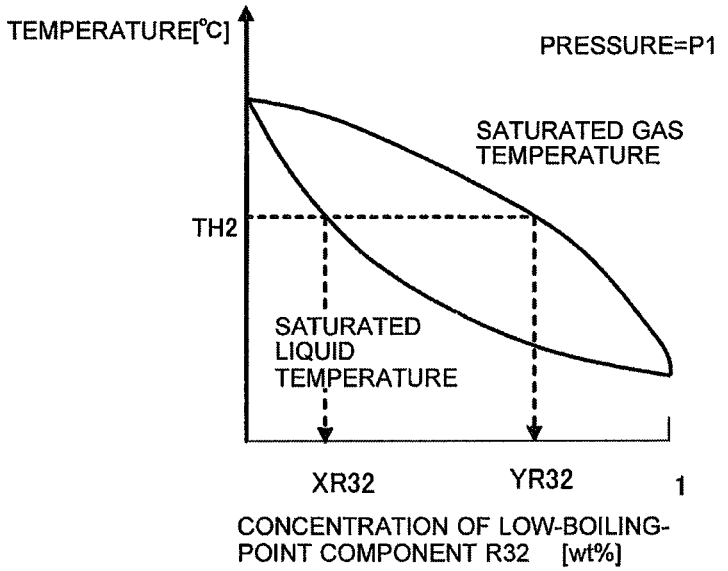
FIG. 14 is a gas-liquid equilibrium diagram illustrating the relationship between the concentration of a liquid low-boiling-point component R32 and the saturated liquid temperature and the relationship between the concentration of a gas low-boiling-point component R32 and the saturated gas.
Figure 15:
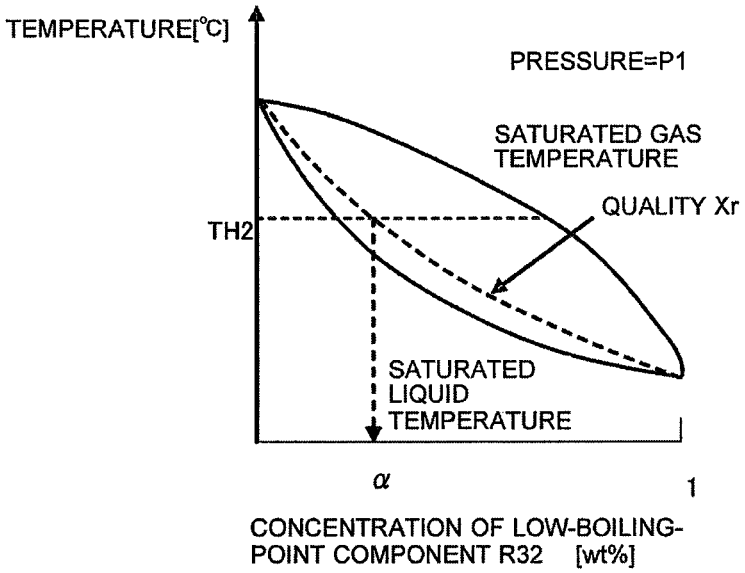
FIG. 15 is a diagram generated by adding the quality Xr to the gas-liquid equilibrium diagram shown in FIG. 14.

FIG. 4 is a gas-liquid equilibrium diagram of a two-component refrigerant mixture under the pressure P1 shown in FIG. 3. FIG. 5 is a flowchart illustrating a flow of a processing for detecting the circulating refrigerant composition executed by the controller 50. FIG. 6 is a ph diagram (pressure (vertical axis)-enthalpy (horizontal axis) diagram) illustrating another phase transition of a refrigerant mixture used in the air-conditioning apparatus 100. FIG. 13 is a flowchart illustrating a flow of another processing operation for detecting the circulating refrigerant composition executed by the controller 50. FIG. 14 is a gas-liquid equilibrium diagram illustrating the relationship between the concentration of a liquid low-boiling-point component R32 and the saturated liquid temperature and the relationship between the concentration of a gas low-boiling-point component R32 and the saturated gas. FIG. 15 is a diagram generated by adding the quality Xr to the gas-liquid equilibrium diagram shown in FIG. 14. A description will now be given, with reference to FIGS. 4 through 6 and FIGS. 13 through 15, of the detection of the circulating composition of a refrigerant circulating within the refrigerant circuit A executed by the air-conditioning apparatus 100.

The two solid lines shown in FIG. 4 indicate a dew-point curve (line (a)), which is a saturated gas line indicating condensing and liquefying of a gas refrigerant, and a boiling-point curve (line (b)), which is a saturated liquid line indicating evaporating and gasifying of a liquid refrigerant. The single broken line indicates the quality Xr (line (c)). In FIG. 4, the vertical axis indicates the temperature, and the horizontal axis indicates the proportion made up of R32 in the circulating composition. The detection of the circulating composition of a two-component refrigerant mixture in which refrigerants are mixed will be discussed below with reference to FIG. 5.

The controller 50 starts processing to execute the detection of the circulating composition of a heat source side refrigerant (ST1). First, the high-pressure-side pressure $P_H$ detected by the high pressure sensor 37, the high-pressure-side temperature $T_H$ detected by the high temperature sensor 32, the low-pressure-side pressure $P_L$ detected by the low pressure sensor 38, and the low-pressure-side temperature $T_L$ detected by the low temperature sensor 33 are input into the controller 50 (ST2). Then, the controller 50 assumes proportion values of two components in the circulating composition of a refrigerant circulating within the refrigerant circuit A as $\alpha 1$ and $\alpha 2$ (ST3). As the initial values of $\alpha 1$ and $\alpha 2$, the mixing ratio of the components of the refrigerant which was charged, for example, 0.7 and 0.3, respectively, may be used, though the initial values are not particularly restricted.

Once refrigerant components are determined, enthalpy of the refrigerant can be calculated from the pressure and the temperature of the refrigerant (see FIG. 6). Accordingly, the controller 50 calculates enthalpy $h_H$ of the refrigerant at the inlet side of the expansion device 14 from the high-pressure-side pressure $P_H$ and the high-pressure-side temperature $T_H$ (ST4, point A shown in FIG. 6). Enthalpy of the refrigerant does not change when the refrigerant is expanded in the expansion device 14. Accordingly, the controller 50 calculates the quality Xr of the two-phase refrigerant at the outlet side of the expansion device 14 from the low-pressure-side pressure $P_L$ and enthalpy $h_H$ using the following equation (1) (ST5, point B shown in FIG. 6).

$$Xr=(h_H-h_b)/(h_d-h_b) \quad \text{Equation (1)}$$

where $h_b$ is enthalpy of a saturated liquid with respect to the low-pressure-side pressure $P_L$, and $h_d$ is enthalpy of a saturated gas with respect to the low-pressure-side pressure $P_L$.

Then, the controller 50 calculates the refrigerant temperature $T_L'$ with respect to the quality Xr from the saturated gas temperature $T_{LG}$ and the saturated liquid temperature $T_{LL}$ under the low-pressure-side pressure $P_L$ using the following equation (2) (ST6).

$$T_L'=T_{LL}\times(1-Xr)+T_{LG}\times Xr \quad \text{Equation (2)}$$

The controller 50 determines whether or not the calculated $T_L'$ is equal to the measured low-pressure-side temperature $T_L$ (ST7). If $T_L'$ is not equal to $T_L$ (ST7; not equal), the controller 50 corrects the assumed proportion values $\alpha 1$ and $\alpha 2$ of the two refrigerant components in the circulating composition (ST8), and repeats processing from ST4. In contrast, if $T_L'$ substantially equal to $T_L$ (ST7; substantially equal), the controller 50 determines that the circulating composition has been fixed, and completes the processing (ST9). By executing the above-described processing, the circulating composition of a two-component zeotropic refrigerant mixture can be detected.

Even in the case of a three-component zeotropic refrigerant mixture, the circulating composition can be calculated in a similar manner. In a three-component zeotropic refrigerant mixture, there is a correlation concerning the ratio of two of the three components, and thus, if the proportion of two components in the circulating composition is assumed, the proportion of the other component in the circulating composition can be calculated. In the above-described example, a description has been given by taking an example in which a two-component refrigerant mixture composed of HFO-1234yf and R32 is circulated. However, the components of refrigerant mixture are not restricted to HFO-1234yf and R32. Another two-component refrigerant mixture including other components having different boiling points may be used, or a refrigerant mixture having three or more components obtained by adding another component to a two-component refrigerant mixture may be used, in which case, the circulating composition can also be calculated in a similar manner.

The correction of $\alpha 1$ and $\alpha 2$ will be discussed below more specifically. It is assumed that a refrigerant mixture of HFO-1234yf and R-32 is used. At the time when the refrigerant mixture was initially charged, the proportion (mixing ratio) made up of HFO-1234yf in the composition was set to be 0.7 (70%) and the proportion made up of R-32 in the composition was set to be 0.3 (30%), and such proportion values are set to be initial values of α1 and α2. It is also assumed that, at the point B in a certain state during an operation, the low-pressure-side pressure $P_L$ is 0.6 MPa, the quality Xr is 0.2, and the measured low-pressure-side temperature $T_1$ is 0 degrees C.

With respect to a pressure of 0.6 MPa, when α1 is 0.8 and α2 is 0.2, the saturated liquid temperature is −0.4 degrees C. and the saturated gas temperature is 8.5 degrees C., when α1 is 0.7 and α2 is 0.3, the saturated liquid temperature is −3.3 degrees C. and the saturated gas temperature is 3.6 degrees C., and when α1 is 0.6 and α2 is 0.4, the saturated liquid temperature is −5.1 degrees C. and the saturated gas temperature is −0.5 degrees C. In this case, the controller 50 stores, in a storage device (not shown), data indicating relationships between α1 and α2 and the saturated liquid temperature and the saturated gas temperature in the form of functions, tables, and so on, and utilizes the data when executing processing.

The temperature $T_L'$ calculated under the above-described conditions on the basis of the above-described equation (2) is 6.7 degrees C. when α1 is 0.8 and α2 is 0.2, the temperature $T_L'$ is 2.2 degrees C. when α1 is 0.7 and α2 is 0.3, and the temperature $T_L'$ is −1.4 when α1 is 0.6 and α2 is 0.4.

Since the measured low-pressure-side temperature $T_L$ is 0 degrees C., α1 is a value in a range from 0.7 to 0.6 and α2 is a value in a range from 0.3 to 0.4. Accordingly, corrections are made to decrease al and to increase α2. In this manner, the circulating composition of a refrigerant mixture which makes the calculated temperature $T_L'$ be equal to the measured temperature $T_L$ is found.

In the above-described example, a description has been given of the detection of the circulating composition of a two-component refrigerant mixture composed of tetrafluoropropene expressed by a chemical formula of $C_3H_2F_4$ and difluoroethane (R32) expressed by a chemical formula of $CH_2F_2$. However, the components of the refrigerant mixture are not restricted to tetrafluoropropene and R32. A two-component zeotropic refrigerant mixture including other components may be used. Additionally, examples of tetrafluoropropene are HFO-1234yf, HFO-1234ze, and so on, and any one of these types may be used.

Alternatively, a three-component refrigerant mixture obtained by adding another component to a two-component refrigerant mixture may be used. For example, even in the case of a three-component zeotropic refrigerant mixture, the circulating composition can be calculated in a similar manner. In a three-component zeotropic refrigerant mixture, there is a correlation concerning the ratio of two of the three components, as stated above. Accordingly, if the total proportion made up of two components in the circulating composition is assumed as, for example, α1, the proportion made up of the remaining component in the circulating composition can be determined as α2. Thus, the circulating composition of a three-component refrigerant mixture can be calculated by means of a processing procedure similar to that for detecting the circulating composition of a two-component refrigerant mixture.

The circulating composition of a refrigerant mixture can be detected in the above-described manner. Then, by detecting the pressure, the saturated liquid temperature and the saturated gas temperature under the detected pressure can be determined by calculations. For example, the average temperature (unweighted average temperature) of the saturated liquid temperature and the saturated gas temperature may be determined as the saturation temperature under the detected pressure, and be used for controlling the compressor 10, the expansion devices 16, and so on. Alternatively, since the heat transfer coefficient of a refrigerant differs depending on the quality, the weighted average temperature may be calculated by weighting each of the saturated liquid temperature and the saturated gas temperature and be used as the saturation temperature. The control of the expansion devices 16 will be discussed later in a description of individual operation modes.

On the low-pressure side (evaporating side), instead of measuring the pressure, the pressure can be determined in the following manner. The temperature of a two-phase refrigerant at the inlet of the evaporator is measured and assumed as the saturated liquid temperature or the temperature of the two-phase refrigerant with respect to a set quality, and then, a relational expression for finding the saturated liquid temperature and the saturated gas temperature from the circulating composition and the pressure is calculated backward, thereby determining the pressure, the saturated gas temperature, and so on. Therefore, the provision of the low pressure sensor 38 is not essential. However, the position at which the temperature is measured has to be assumed as the saturated liquid temperature, or the quality has to be set. Thus, the use of the low pressure sensor 38 makes it possible to more precisely determine the saturated liquid temperature and the saturated gas temperature.

There is a refrigerant mixture which exhibits characteristics in which, in the high-pressure side (condensing side), isothermal lines in a subcooled liquid area, such as those shown in FIG. 6, are substantially perpendicular, that is, the temperature does not change in accordance with the pressure. For example, a refrigerant mixture of HFO-1234yf (tetrafluoropropene) and R32 exhibits such characteristics. Accordingly, for some refrigerant mixtures, even if the high pressure sensor 37 is not provided, enthalpy $h_H$ can be determined only from the liquid temperature. Thus, the provision of the high pressure sensor 37 is not essential.

As the expansion device 14, an electronic expansion valve in which the opening degree is variable or a valve in which the expansion amount is fixed, such as a capillary tube, may be used. As the inter-refrigerant heat exchanger 20, a double-pipe heat exchanger may preferably be used. However, the inter-refrigerant heat exchanger 20 is not restricted to this type, and a plate heat exchanger or a microchannel heat exchanger may be used. Any type of heat exchanger may be used as long as heat exchange between a high pressure refrigerant and a low pressure refrigerant can be performed. Additionally, FIG. 2 shows an example in which the low pressure sensor 38 is installed in a flow channel between the accumulator 19 and the first refrigerant flow channel switching device 11. However, the position of the low pressure sensor 38 is not restricted to such a position. The low pressure sensor 38 may be installed at any position, such as in a flow channel between the compressor 10 and the accumulator 19, as long as it can measure the low-pressure-side pressure of the compressor 10. Additionally, the position of the high pressure sensor 37 is not restricted to the position shown in the drawing, and the high pressure sensor 37 may also be installed at any position as long as it can measure the high-pressure-side pressure of the compressor 10.

As a circulating-composition detecting method executed by the air-conditioning apparatus 100, the method shown in FIG. 5 may be used, or another method may be used. Another circulating-composition detecting method executed by the air-conditioning apparatus 100 will be discussed below with reference to FIG. 13. In this method, a composition ratio of a refrigerant charged into the air-conditioning apparatus 100 is set to be a circulating composition αb. However, experiments may be conducted in advance, and the circulating composition which was frequently found through experiments may be set as the circulating composition αb. A physical-property table of the temperature and the saturated liquid enthalpy with respect to the set circulating composition is preferably stored in storage means, such as a ROM. A physical-property table of the temperature and the saturated liquid enthalpy with respect to the charging composition and the saturated gas enthalpy are also preferably stored in storage means in advance.

The controller 50 determines the quality Xr in a manner similar to that indicated in the flow shown in FIG. 5 (ST11 through ST15). The quality Xr obtained in this manner is a quality in the charging composition.

Then, the controller 50 determines the concentration XR32 of a liquid low-boiling-point component and the concentration YR32 of a gas low-boiling-point component from the low-pressure-side temperature $T_L$ and the pressure of the refrigerant which is positioned on the downstream side of the expansion device 14 and which has not been sucked into the compressor 10 (ST16). The relationship between the concentration of the liquid low-boiling-point component R32 and the saturated liquid temperature and the relationship between the concentration of the gas low-boiling-point component R32 and the saturated gas temperature are shown in FIG. 14. The degree of freedom F of a two-component refrigerant mixture in a two-phase gas-liquid state is calculated to be 2 (F=2) according to equation (3). That is, by determining two elements among independent variables, the state of this system can be determined.

$$F=n+2-r \qquad \text{Equation (3)}$$

where F is a degree of freedom, n is the number of components, and r is the number of phases.

That is, the state of a two-phase refrigeration cycle can be determined from the pressure and the temperature of a refrigerant flowing through the high/low pressure bypass pipe 4*c*, and FIG. 14 shows that the concentration of the liquid low-boiling-point component (R32) in this state is XR32 and the concentration of the gas low-boiling-point component (R32) in this state is YR32. More specifically, relationships among the pressure P, the temperature T, the saturated liquid concentration, and the saturated gas concentration are stored in storage means in advance, and the controller 50 determines the saturated liquid concentration XR32 and the saturated gas concentration YR32 by referring to this table (ST16).

If the quality Xr is found, as shown in FIG. 15, the circulating refrigerant composition can be determined from FIG. 14. Accordingly, by using the saturated liquid concentration XR32 and the saturated gas concentration YR32 obtained in ST16 and the quality Xr obtained in ST15, the controller 50 calculates the proportion value a in the circulating composition using equation (4) (ST17).

$$\text{Proportion value in circulating composition}\quad \alpha=(1-Xr)\cdot XR32+Xr\cdot YR32 \qquad \text{Equation (4)}$$

The controller 50 outputs the obtained proportion value a in the circulating composition (ST18). By using this proportion value a in the circulating composition, the controller 50 calculates the evaporating temperature, the condensing temperature, the saturation temperature, the degree of superheat, and the degree of subcooling in the air-conditioning apparatus 100, and, on the basis of these values, the controller 50 controls the opening degree of the expansion device, the rotation speed of the compressor 10, the speed of a fan, and so on so that the performance of the air-conditioning apparatus can be maximized. The circulating composition of a refrigerant mixture can be detected in the above-described manner.

When it is necessary to detect the circulating composition, the opening/closing device 17*c* is opened so as to cause a refrigerant to flow through the high/low pressure bypass pipe 4*c*. In contrast, when it is not necessary to detect the circulating composition since a refrigeration cycle is stable, that is, when it is not necessary to measure the circulating composition again since the circulating composition has already been detected and the state of the refrigeration cycle has not changed from the state at the time of the measurement of the circulating composition, the opening/closing device 17*c* is closed so as not to cause a refrigerant to flow through the high/low pressure bypass pipe 4*c*. With this arrangement, a refrigerant does not flow through the high/low pressure bypass pipe 4*c* when the refrigeration cycle is stable, thereby decreasing the loss and improving the operation efficiency. The criteria for judging whether the opening/closing device 17*c* is opened or closed will be discussed later (stable state judgment processing (1) and stable state judgment processing (2)).

{Operation of Air-Conditioning Apparatus 100}

Individual operation modes performed by the air-conditioning apparatus 100 will be described below. This air-conditioning apparatus 100 is capable of performing, on the basis of an instruction from each indoor unit 2, a cooling operation or a heating operation in the indoor unit 2. That is, the air-conditioning apparatus 100 is capable of performing the same operation in all the indoor units 2 or of performing different operations in the individual indoor units 2.

Operation modes performed by the air-conditioning apparatus 100 are a cooling only operation in which all the driven indoor units 2 perform a cooling operation, a heating only operation in which all the driven indoor units 2 perform a heating operation, and a cooling and heating mixed operation mode. The cooling and heating mixed operation mode includes a cooling main operation mode in which a cooling load is greater than a heating load, and a heating main operation mode in which a heating load is greater than a cooling load. The individual operation modes will be described below, together with a description of the flow of a heating source side refrigerant and the flow of a heat medium.

[Cooling Only Operation Mode]

Figure 7:
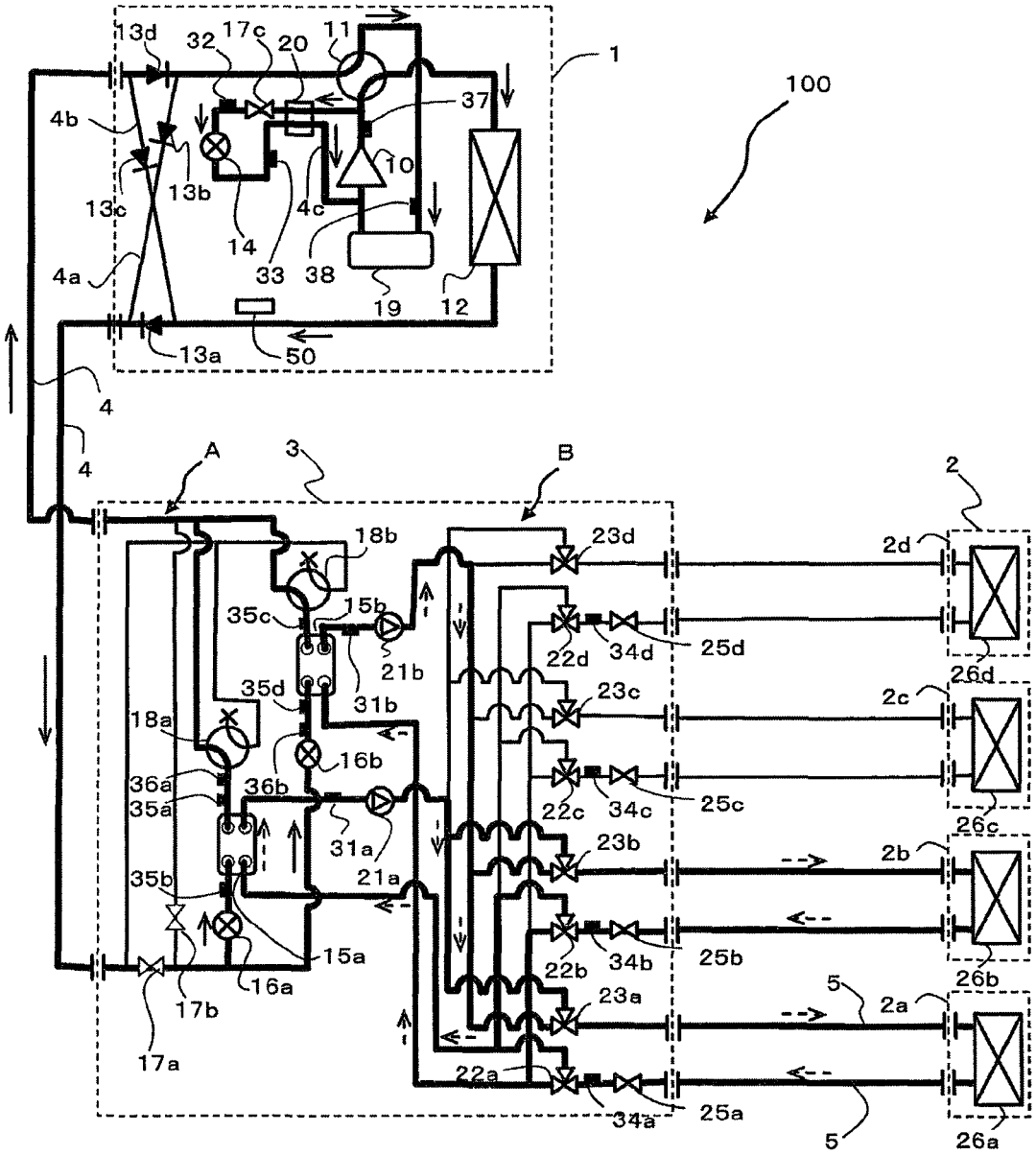
FIG. 7 is a refrigerant circuit diagram illustrating a flow of a refrigerant in a cooling only operation mode performed by the air-conditioning apparatus according to Embodiment of the present invention.

FIG. 7 is a refrigerant circuit diagram illustrating a flow of a refrigerant in the cooling only operation mode performed by the air-conditioning apparatus 100. The cooling only operation mode will be discussed with reference to FIG. 7 by taking, as an example, a case in which a cooling load is generated only in the use side heat exchangers 26*a* and 26*b*. In FIG. 7, the pipes indicated by the thick lines are pipes through which refrigerants (a heat source side refrigerant and a heat medium) flow. In FIG. 7, the direction in which a heat source side refrigerant flows is indicated by the solid arrows, and the direction in which a heat medium flows is indicated by the dotted arrows.

In the case of the cooling only operation mode shown in FIG. 7, in the outdoor unit 1, the first refrigerant flow channel switching device 11 is switched so that a heat source side refrigerant discharged from the compressor 10 will flow into the heat-source-side heat exchanger 12. In the heat medium relay unit 3, the pumps 21*a* and 21*b* are driven to open the heat medium flow control devices 25*a* and 25*b* and to set the heat medium flow control devices 25*c* and 25*d* in the full closed state, thereby allowing a heat medium to circulate between the intermediate heat exchanger 15*a* and the use side heat exchangers 26*a* and 26*b* and between the intermediate heat exchanger 15*b* and the use side heat exchangers 26*a* and 26*b*.

A description will first be given of the flow of a heat source side refrigerant in the refrigerant circuit A.

A low-temperature low-pressure refrigerant is compressed by the compressor 10 and is discharged as a high-temperature high-pressure gas refrigerant. The high-temperature high-pressure gas refrigerant discharged from the compressor 10 flows into the heat-source-side heat exchanger 12 via the first refrigerant flow channel switching device 11. Then, in the heat-source-side heat exchanger 12, the high-temperature high-pressure gas refrigerant is condensed and liquefied while transferring heat to outdoor air and is transformed into a high-pressure liquid refrigerant. The high-pressure liquid refrigerant flowing out of the heat-source-side heat exchanger 12 flows out of the outdoor unit 1 via the check valve 13*a* and flows into the heat medium relay unit 3 via the refrigerant pipe 4. The high-pressure liquid refrigerant flowing into the heat medium relay unit 3 is diverted toward the expansion devices 16*a* and 16*b* after passing through the opening/closing device 17*a*. The high-pressure liquid refrigerant is then expanded to a low-temperature low-pressure two-phase refrigerant in the expansion devices 16*a* and 16*b*.

This two-phase refrigerant flows into each of the intermediate heat exchangers 15*a* and 15*b*, which serve as evaporators, and receives heat from a heat medium circulating in the heat medium circuit B. In this manner, the two-phase refrigerant is transformed into a low-temperature low-pressure gas refrigerant while cooling the heat medium. The gas refrigerant flowing out of the intermediate heat exchangers 15*a* and 15*b* flows out of the heat medium relay unit 3 via the second refrigerant flow channel switching devices 18*a* and 18*b*, respectively, and again flows into the outdoor unit 1 via the refrigerant pipe 4. The refrigerant flowing into the outdoor unit 1 passes through the check value 13*d* and is again sucked into the compressor 10 via the first refrigerant flow channel switching device 11 and the accumulator 19.

The circulating composition of a refrigerant which is circulating within the refrigeration cycle is measured by means of the circulating-composition detecting circuit. The controller 50 of the outdoor unit 1 and a control unit (not shown) of the heat medium relay unit 3 (or the indoor unit 2) are connected to each other wirelessly or with a wired medium such that they can communicate with each other. The circulating composition measured in the outdoor unit 1 is transmitted from the controller 50 to the control unit of the heat medium relay unit 3 (or the indoor unit 2) by means of communication. The opening/closing device 17*c* is opened.

The saturated liquid temperature and the saturated gas temperature are calculated from the detected circulating composition and with the use of the first pressure sensor 36*a*, and the average temperature of the saturated liquid temperature and the saturated gas temperature is determined to be the evaporating temperature. The opening degree of the expansion device 16*a* is controlled so that the superheat (degree of superheat) obtained as a temperature difference between the temperature detected by the third temperature sensor 35*a* and the calculated evaporating temperature will become constant. Similarly, the opening degree of the expansion device 16*b* is controlled so that the superheat obtained as a temperature difference between the temperature detected by the third temperature sensor 35*c* and the calculated evaporating temperature will become constant. The opening/closing device 17*a* is opened, and the opening/closing device 17*b* is dosed.

Alternatively, by assuming, from the detected circulating composition and with the use of the third temperature sensor 35*b*, the temperature detected by the third temperature sensor 35*b* as the saturated liquid temperature or the temperature with respect to a set quality, the saturation pressure and the saturated gas temperature may be calculated. Then, the average temperature of the saturated liquid temperature and the saturated gas temperature may be determined to be the saturation temperature, and the determined saturation temperature may be used for controlling the expansion devices 16*a* and 16*b*. In this case, the provision of the first pressure sensor 36*a* is not necessary, and the system can be constructed at low cost.

A description will now be given of the flow of a heat medium in the heat medium circuit B.

In the cooling only operation mode, cooling energy of a heat source side refrigerant is transmitted to a heat medium in both of the intermediate heat exchangers 15*a* and 15*b*, and the cooled heat medium circulates within the pipes 5 by the pumps 21*a* and 21*b*. The heat medium pressurized in the pumps 21*a* and 21*b* flows out of the pumps 21*a* and 21*b* into the use side heat exchangers 26*a* and 26*b*, respectively, via the second heat-medium flow channel switching devices 23*a* and 23*b*, respectively. Then, the heat medium receives heat from indoor air in the use side heat exchangers 26*a* and 26*b*, thereby cooling the indoor space 7.

Then, the heat medium flows out of the use side heat exchangers 26*a* and 26*b* and flows into the heat medium flow control devices 25*a* and 25*b*, respectively. In this case, due to the functions of the heat medium flow control devices 25*a* and 25*b*, the flow rate of the heat medium is set to be a flow rate which is necessary to satisfy an air conditioning load required indoors, and then, the heat medium flows into the use side heat exchangers 26*a* and 26*b*. The heat medium flowing out of the heat medium flow control devices 25*a* and 25*b* passes through the first heat-medium flow channel switching devices 22*a* and 22*b*, respectively, flows into the intermediate heat exchangers 15*a* and 15*b*, and is then sucked into the pumps 21*a* and 21*b* again.

In the pipes 5 connected to the use side heat exchanger 26, a heat medium flows in the direction from the second heat-medium flow channel switching device 23 to the first heat-medium flow channel switching device 22 via the heat medium flow control device 25. An air conditioning load required in the indoor space 7 can be satisfied by performing control so that the difference between the temperature detected by the first temperature sensor 31*a* or 31*b* and the temperature detected by the second temperature sensor 34 will be maintained at a target value. As the temperature at the outlet of the intermediate heat exchanger 15, either of the temperature of the first temperature sensor 31*a* or that of the first temperature sensor 31*b* may be used, or the average of these temperatures may be used. In this case, the opening degrees of the first heat-medium flow channel switching device 22 and the second heat-medium flow channel switching device 23 are set to be an intermediate degree so that it is possible to secure flow channels through which a heat medium flows both to the intermediate heat exchangers 15*a* and 15*b*.

Figure 9:
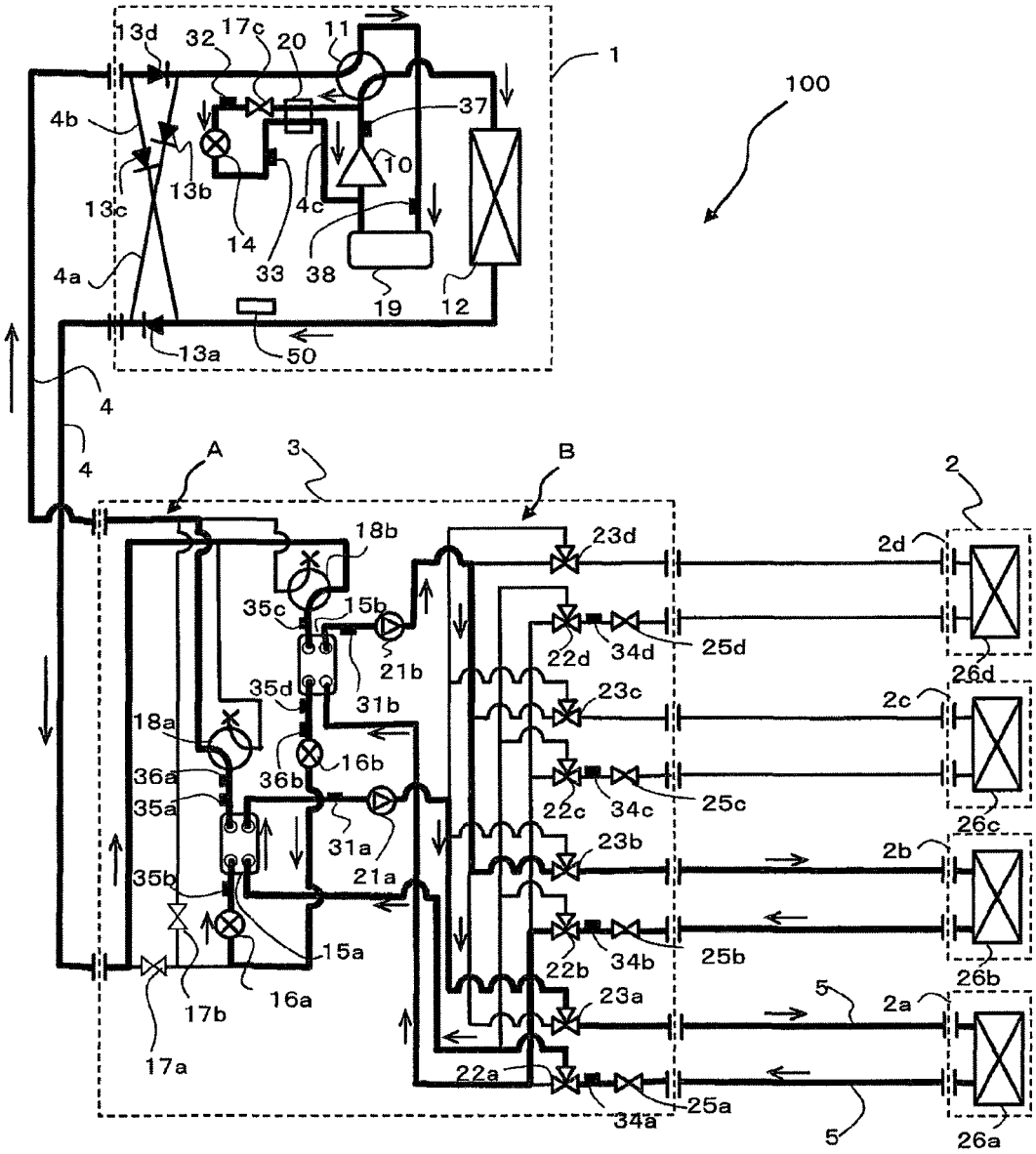
FIG. 9 is a refrigerant circuit diagram illustrating a flow of a refrigerant in a cooling main operation mode performed by the air-conditioning apparatus according to Embodiment of the present invention.

When the cooling only operation mode is performed, it is not necessary to cause a heat medium to flow into use side heat exchangers 26 without a heat load (including a case in which a thermostat is OFF). Accordingly, flow channels to such use side heat exchangers 26 are closed by using the associated heat medium flow control devices 25, thereby preventing a heat medium from flowing into such use side heat exchangers 26. In FIG. 9, since the use side heat exchangers 26*a* and 26*b* have a heat load, a heat medium flows into the use side heat exchangers 26*a* and 26*b*. However, the use side heat exchangers 26*c* and 26*d* do not have a heat load, and thus, the associated heat medium flow control devices 25*c* and 25*d* are set in the full closed position. When a heat load is generated in the use side heat exchanger 26*c* or 26*d*, the heat medium flow control device 25*c* or 25*d* is opened, thereby allowing a heat medium to circulate.

[Heating Only Operation Mode]

Figure 8:
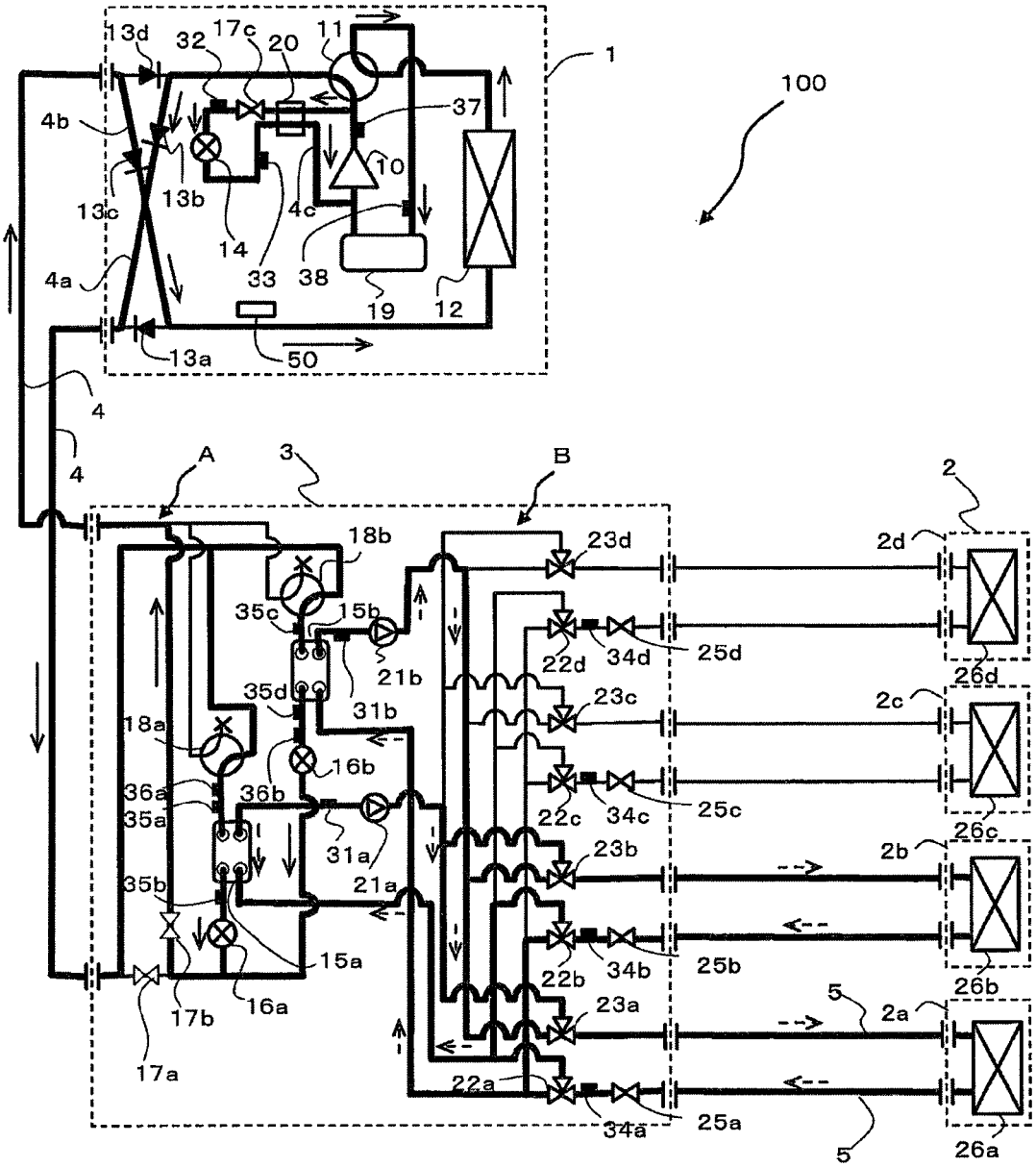
FIG. 8 is a refrigerant circuit diagram illustrating a flow of a refrigerant in a heating only operation mode performed by the air-conditioning apparatus according to Embodiment of the present invention.

FIG. 8 is a refrigerant circuit diagram illustrating a flow of a refrigerant in the heating only operation mode performed by the air-conditioning apparatus 100. The heating only operation mode will be discussed with reference to FIG. 8 by taking, as an example, a case in which a heating load is generated only in the use side heat exchangers 26*a* and 26*b*. In FIG. 8, the pipes indicated by the thick lines are pipes through which refrigerants (a heat source side refrigerant and a heat medium) flow. In FIG. 8, the direction in which a heat source side refrigerant flows is indicated by the solid arrows, and the direction in which a heat medium flows is indicated by the dotted arrows.

In the case of the heating only operation mode shown in FIG. 8, in the outdoor unit 1, the first refrigerant flow channel switching device 11 is switched so that a heat source side refrigerant discharged from the compressor 10 will flow into the heat medium relay unit 3 without passing through the heat-source-side heat exchanger 12. In the heat medium relay unit 3, the pumps 21*a* and 21*b* are driven to open the heat medium flow control devices 25*a* and 25*b* and to set the heat medium flow control devices 25*c* and 25*d* in the full closed state, thereby allowing a heat medium to circulate between the intermediate heat exchanger 15*a* and the use side heat exchangers 26*a* and 26*b* and between the intermediate heat exchanger 15*b* and the use side heat exchangers 26*a* and 26*b*.

A description will first be given of the flow of a heat source side refrigerant in the refrigerant circuit A.

A low-temperature low-pressure refrigerant is compressed by the compressor 10 and is discharged as a high-temperature high-pressure gas refrigerant. The high-temperature high-pressure gas refrigerant discharged from the compressor 10 passes through the first refrigerant flow channel switching device 11 and the first connecting pipe 4*a*, passes through the check value 13*b*, and flows out of the outdoor unit 1. The high-temperature high-pressure gas refrigerant flowing out of the outdoor unit 1 flows into the heat medium relay unit 3 via the refrigerant pipe 4. The high-temperature high-pressure gas refrigerant flowing into the heat medium relay unit 3 is diverted, passes through the second refrigerant flow channel switching devices 18*a* and 18*b*, and then flows into each of the intermediate heat exchangers 15*a* and 15*b*.

This high-temperature high-pressure gas refrigerant flowing into the intermediate heat exchangers 15*a* and 15*b* is condensed and liquefied while transferring heat to a heat medium circulating in the heat medium circuit B, and is transformed into a high-pressure liquid refrigerant. The liquid refrigerant flowing out of the intermediate heat exchangers 15*a* and 15*b* is expanded in the expansion devices 16*a* and 16*b* into a low-temperature low-pressure two-phase refrigerant. This two-phase refrigerant flows out of the heat medium relay unit 3 via the opening/closing device 17*b*, and again flows into the outdoor unit 1 via the refrigerant pipe 4. The refrigerant flowing into the outdoor unit 1 flows into the second connecting pipe 4*b*, passes through the check valve 13*c*, and flows into the heat-source-side heat exchanger 12, which serves as an evaporator.

Then, the heat source side refrigerant flowing into the heat-source-side heat exchanger 12 receives heat from outdoor air in the heat-source-side heat exchanger 12 and is transformed into a low-temperature low-pressure gas refrigerant. The low-temperature low-pressure gas refrigerant flowing out of the heat-source-side heat exchanger 12 is again sucked into the compressor 10 via the first refrigerant flow channel switching device 11 and the accumulator 19.

The saturated liquid temperature and the saturated gas temperature are calculated from the detected circulating composition and with the use of the first pressure sensor 36*a*, and the average temperature of the saturated liquid temperature and the saturated gas temperature is determined to be the condensing temperature. The opening degree of the expansion device 16*a* is controlled so that subcooling (degree of subcooling) obtained as a temperature difference between the temperature detected by the third temperature sensor 35*b* and the calculated condensing temperature will become constant. Similarly, the opening degree of the expansion device 16*b* is controlled so that subcooling obtained as a temperature difference between the temperature detected by the third temperature sensor 35*d* and the calculated condensing temperature will become constant. The opening/closing device 17*a* is closed, and the opening/closing device 17*b* is opened. The circulating composition of the refrigerant circulating within the refrigeration cycle is measured in a manner similar to that measured in the cooling only operation. The opening/closing device 17*c* is opened.

Alternatively, by assuming, from the detected circulating composition and with the use of the third temperature sensor 35*b*, the temperature detected by the third temperature sensor 35*b* as the saturated liquid temperature or the temperature with respect to a set quality, the saturation pressure and the saturated gas temperature may be calculated. Then, the average temperature of the saturated liquid temperature and the saturated gas temperature may be determined to be the saturation temperature, and the determined saturation temperature may be used for controlling the expansion devices 16*a* and 16*b*. In this case, the provision of the first pressure sensor 36*a* is not necessary, and the system can be constructed at low cost.

A description will now be given of the flow of a heat medium in the heat medium circuit B.

In the heating only operation mode, heating energy of a heat source side refrigerant is transmitted to a heat medium in both of the intermediate heat exchangers 15*a* and 15*b*, and the heated heat medium circulates within the pipes 5 by the pumps 21*a* and 21*b*. The heat medium pressurized in the pumps 21*a* and 21*b* flows out of the pumps 21*a* and 21*b* into the use side heat exchangers 26*a* and 26*b*, respectively, via the second heat-medium flow channel switching devices 23*a* and 23*b*, respectively. Then, the heat medium transfers heat to indoor air in the use side heat exchangers 26*a* and 26*b*, thereby heating the indoor space 7.

Then, the heat medium flows out of the use side heat exchangers 26*a* and 26*b* and flows into the heat medium flow control devices 25*a* and 25*b*, respectively. In this case, due to the functions of the heat medium flow control devices 25*a* and 25*b*, the flow rate of the heat medium is set to be a flow rate which is necessary to satisfy an air conditioning load required indoors, and then, the heat medium flows into the use side heat exchangers 26*a* and 26*b*. The heat medium flowing out of the heat medium flow control devices 25*a* and

25*b* passes through the first heat-medium flow channel switching devices 22*a* and 22*b*, respectively, flows into the intermediate heat exchangers 15*a* and 15*b*, and is then sucked into the pumps 21*a* and 21*b* again.

In the pipes 5 connected to the use side heat exchanger 26, a heat medium flows in the direction from the second heat-medium flow channel switching device 23 to the first heat-medium flow channel switching device 22 via the heat medium flow control device 25. An air conditioning load required in the indoor space 7 can be satisfied by performing control so that the difference between the temperature detected by the first temperature sensor 31*a* or 31*b* and the temperature detected by the second temperature sensor 34 will be maintained at a target value. As the temperature at the outlet of the intermediate heat exchanger 15, either of the temperature of the first temperature sensor 31*a* or that of the first temperature sensor 31*b* may be used, or the average of these temperatures may be used.

In this case, the opening degrees of the first heat-medium flow channel switching device 22 and the second heat-medium flow channel switching device 23 are set to be an intermediate opening degree so that it is possible to secure flow channels through which a heat medium flows both to the intermediate heat exchangers 15*a* and 15*b*. Moreover, the use side heat exchanger 26*a* should be controlled by the difference between the temperature at the inlet and that at the outlet. However, the temperature of a heat medium at the inlet side of the use side heat exchanger 26 is substantially the same as the temperature detected by the first temperature sensor 31*b*. Accordingly, by the use of the first temperature sensor 31*b*, the number of temperature sensors can be decreased, and the system can be constructed at low cost.

As has been discussed in the cooling only operation mode, the opening and closing of the heat medium flow control devices 25 is controlled, depending on whether or not there is a heat load.

[Cooling Main Operation Mode]

FIG. 9 is a refrigerant circuit diagram illustrating a flow of a refrigerant in the cooling main operation mode performed by the air-conditioning apparatus 100. The cooling main operation mode will be discussed with reference to FIG. 9 by taking, as an example, a case in which a cooling load is generated in the use side heat exchanger 26*a* and a heating load is generated in the use side heat exchanger 26*b*. In FIG. 9, the pipes indicated by the thick lines are pipes through which refrigerants (a heat source side refrigerant and a heat medium) circulate. In FIG. 9, the direction in which a heat source side refrigerant flows is indicated by the solid arrows, and the direction in which a heat medium flows is indicated by the dotted arrows.

In the case of the cooling main operation mode shown in FIG. 9, in the outdoor unit 1, the first refrigerant flow channel switching device 11 is switched so that a heat source side refrigerant discharged from the compressor 10 will flow into the heat-source-side heat exchanger 12. In the heat medium relay unit 3, the pumps 21*a* and 21*b* are driven to open the heat medium flow control devices 25*a* and 25*b* and to set the heat medium flow control devices 25*c* and 25*d* in the full closed state, thereby allowing a heat medium to circulate between the intermediate heat exchanger 15*a* and the use side heat exchanger 26*a* and between the intermediate heat exchanger 15*b* and the use side heat exchanger 26*b*.

A description will first be given of the flow a heat source side refrigerant in the refrigerant circuit A.

A low-temperature low-pressure refrigerant is compressed by the compressor 10 and is discharged as a high-temperature high-pressure gas refrigerant. The high-temperature high-pressure gas refrigerant discharged from the compressor 10 flows into the heat-source-side heat exchanger 12 via the first refrigerant flow channel switching device 11. Then, in the heat-source-side heat exchanger 12, the high-temperature high-pressure gas refrigerant is condensed into a two-phase refrigerant while transferring heat to outdoor air. The two-phase refrigerant flowing out of the heat-source-side heat exchanger 12 flows out of the outdoor unit 1 via the check valve 13*a*, and flows into the heat medium relay unit 3 via the refrigerant pipe 4. The two-phase refrigerant flowing into the heat medium relay unit 3 passes through the second refrigerant flow channel switching device 18*b* and flows into the intermediate heat exchanger 15*b*, which serves as a condenser.

The two-phase refrigerant flowing into the intermediate heat exchanger 15*b* is condensed and liquefied while being transferring heat to a heat medium circulating in the heat medium circuit B, and is transformed into a liquid refrigerant. The liquid refrigerant flowing out of the intermediate heat exchanger 15*b* is expanded into a low-pressure two-phase refrigerant in the expansion device 16*b*. This low-pressure two-phase refrigerant flows into the intermediate heat exchanger 15*a*, which serves as an evaporator, via the expansion device 16*a*. The low-pressure two-phase refrigerant flowing into the intermediate heat exchanger 15*a* receives heat from a heat medium circulating in the heat medium circuit B and is thereby transformed into a low-pressure gas refrigerant while cooling the heat medium. This gas refrigerant flows out of the intermediate heat exchanger 15*a*, flows out of the heat medium relay unit 3 via the second refrigerant flow channel switching device 18*a*, and again flows into the outdoor unit 1 via the refrigerant pipe 4. The heat source side refrigerant flowing into the outdoor unit 1 passes through the check value 13*d* and is again sucked into the compressor 10 via the first refrigerant flow channel switching device 11 and the accumulator 19.

The saturated liquid temperature and the saturated gas temperature are calculated from the detected circulating composition and with the use of the first pressure sensor 36*b*, and the average temperature of the saturated liquid temperature and the saturated gas temperature is determined to be the evaporating temperature. The opening degree of the expansion device 16*b* is controlled so that the superheat (degree of superheat) obtained as a temperature difference between the temperature detected by the third temperature sensor 35*a* and the calculated evaporating temperature will become constant. The expansion device 16*a* is set in the full opened state. The opening/closing device 17*a* is closed, and the opening/closing device 17*b* is closed. The circulating composition of the refrigerant circulating within the refrigeration cycle is measured in a manner similar to that measured in the cooling only operation. The opening/closing device 17*c* is opened.

The saturated liquid temperature and the saturated gas temperature may be calculated from the detected circulating composition and with the use of the first pressure sensor 36*b*, and the average temperature of the saturated liquid temperature and the saturated gas temperature is determined to be the condensing temperature. The opening degree of the expansion device 16*b* may be controlled so that subcooling (degree of subcooling) obtained as a temperature difference between the temperature detected by the third temperature sensor 35*d* and the calculated condensing temperature will become constant. Alternatively, the expansion device 16*b* may be set in the full opened state, and superheat or subcooling may be controlled by the expansion device 16*a*.

Alternatively, by assuming, from the detected circulating composition and with the use of the third temperature sensor 35*b*, the temperature detected by the third temperature sensor 35*b* as the saturated liquid temperature or the temperature with respect to a set quality, the saturation pressure and the saturated gas temperature may be calculated. Then, the average temperature of the saturated liquid temperature and the saturated gas temperature may be determined to be the saturation temperature, and the determined saturation temperature may be used for controlling the expansion device 16*a* or 16*b*. In this case, the provision of the first pressure sensor 36*a* is not necessary, and the system can be constructed at low cost.

A description will now be given of the flow of a heat medium in the heat medium circuit B.

In the cooling main operation mode, heating energy of a heat source side refrigerant is transmitted to a heat medium in the intermediate heat exchanger 15*b*, and the heated heat medium circulates within the pipes 5 by the pump 21*b*. Moreover, in the cooling main operation mode, cooling energy of a heat source side refrigerant is transmitted to a heat medium in the intermediate heat exchanger 15*a*, and the cooled heat medium circulates within the pipes 5 by the pump 21*a*. The heat medium pressurized in the pumps 21*a* and 21*b* flows into the use side heat exchangers 26*a* and 26*b*, respectively, via the second heat-medium flow channel switching devices 23*a* and 23*b*, respectively.

In the use side heat exchanger 26*b*, the heat medium transfers heat to indoor air, thereby heating the indoor space 7. In the use side heat exchanger 26*a*, the heat medium receives heat from indoor air, thereby cooling the indoor space 7. In this case, due to the functions of the heat medium flow control devices 25*a* and 25*b*, the flow rate of the heat medium is set to be a flow rate which is necessary to satisfy an air conditioning load required indoors, and then, the heat medium flows into the use side heat exchangers 26*a* and 26*b*. The heat medium with a slightly reduced temperature after passing through the use side heat exchanger 26*b* passes through the heat medium flow control device 25*b* and the first heat-medium flow channel switching device 22*b*, flows into the intermediate heat exchanger 15*b*, and is then sucked into the pump 21*b* again. The heat medium with a slightly increased temperature after passing through the use side heat exchanger 26*a* passes through the heat medium flow control device 25*a* and the first heat-medium flow channel switching device 22*a*, flows into the intermediate heat exchanger 15*a*, and is then sucked into the pump 21*a* again.

During this operation, due to the functions of the first and second heat-medium flow channel switching devices 22 and 23, a heated heat medium and a cooled heat medium are respectively fed to a use side heat exchanger 26 with a heating load and a use side heat exchanger 26 with a cooling load without being mixed with each other. In the pipes 5 connected to the use side heat exchangers 26 for both of the heating side and the cooling side, a heat medium flows in the direction from the second heat-medium flow channel switching devices 23 to the first heat-medium flow channel switching devices 22 via the heat medium flow control devices 25. An air conditioning load required in the indoor space 7 can be satisfied by performing control so that, for the heating side, the difference between the temperature detected by the first temperature sensor 31*b* and the temperature detected by the second temperature sensor 34 will be maintained at a target value, and so that, for the cooling side, the difference between the temperature detected by the first temperature sensor 31*a* and the temperature detected by the second temperature sensor 34 will be maintained at a target value.

As has been discussed in the cooling only operation mode, the opening and closing of the heat medium flow control devices 25 is controlled, depending on whether or not there is a heat load.

[Heating Main Operation Mode]

Figure 10:
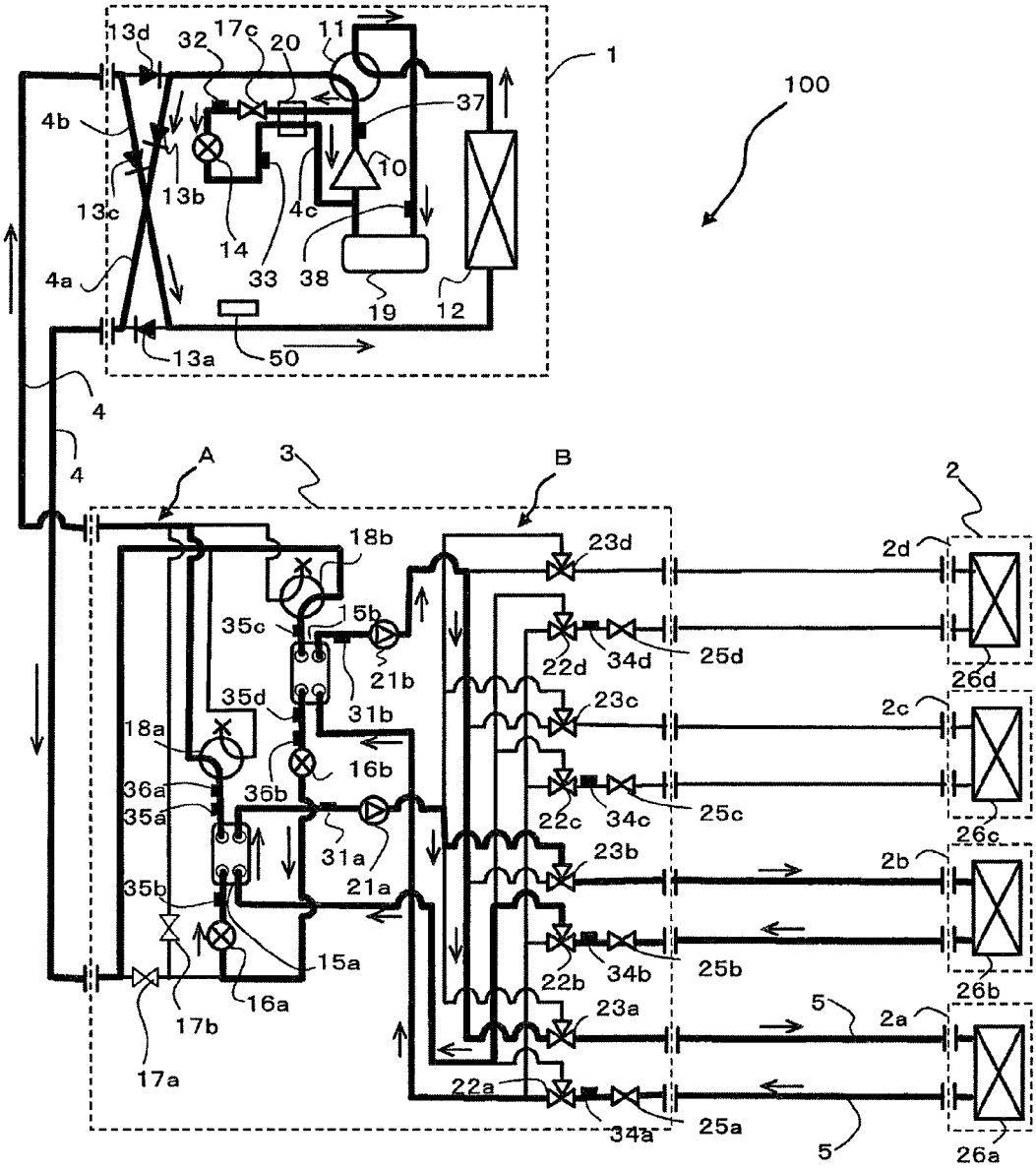
FIG. 10 is a refrigerant circuit diagram illustrating a flow of a refrigerant in a heating main operation mode performed by the air-conditioning apparatus according to Embodiment of the present invention.

FIG. 10 is a refrigerant circuit diagram illustrating a flow of a refrigerant in the heating main operation mode performed by the air-conditioning apparatus 100. The heating main operation mode will be discussed with reference to FIG. 10 by taking, as an example, a case in which a heating load is generated in the use side heat exchanger 26*a* and a cooling load is generated in the use side heat exchanger 26*b*. In FIG. 10, the pipes indicated by the thick lines are pipes through which refrigerants (a heat source side refrigerant and a heat medium) circulate. In FIG. 10, the direction in which a heat source side refrigerant flows is indicated by the solid arrows, and the direction in which a heat medium flows is indicated by the dotted arrows.

In the case of the heating main operation mode shown in FIG. 10, in the outdoor unit 1, the first refrigerant flow channel switching device 11 is switched so that a heat source side refrigerant discharged from the compressor 10 will flow into the heat medium relay unit 3 without passing through the heat-source-side heat exchanger 12. In the heat medium relay unit 3, the pumps 21*a* and 21*b* are driven to open the heat medium flow control devices 25*a* and 25*b* and to set the heat medium flow control devices 25*c* and 25*d* in the full closed state, thereby allowing a heat medium to circulate between the intermediate heat exchanger 15*a* and the use side heat exchanger 26*b* and between the intermediate heat exchanger 15*a* and the use side heat exchanger 26*b*.

A description will first be given of the flow of a heat source side refrigerant in the refrigerant circuit A.

A low-temperature low-pressure refrigerant is compressed by the compressor 10 and is discharged as a high-temperature high-pressure gas refrigerant. The high-temperature high-pressure gas refrigerant discharged from the compressor 10 passes through the first refrigerant flow channel switching device 11 and the first connecting pipe 4*a*, passes through the check value 13*b*, and flows out of the outdoor unit 1. The high-temperature high-pressure gas refrigerant flowing out of the outdoor unit 1 flows into the heat medium relay unit 3 via the refrigerant pipe 4. The high-temperature high-pressure gas refrigerant flowing into the heat medium relay unit 3 passes through the second refrigerant flow channel switching device 18*b* and flows into the intermediate heat exchanger 15*b*, which serves as a condenser.

The gas refrigerant flowing into the intermediate heat exchanger 15*b* is condensed and liquefied while transferring heat to a heat medium circulating in the heat medium circuit B, and is transformed into a liquid refrigerant. The liquid refrigerant flowing out of the intermediate heat exchanger 15*b* is expanded to a low-pressure two-phase refrigerant in the expansion device 16*b*. This low-pressure two-phase refrigerant flows into the intermediate heat exchanger 15*a*, which serves as an evaporator, via the expansion device 16*a*. The low-pressure two-phase refrigerant flowing into the intermediate heat exchanger 15*a* receives heat from a heat medium circulating in the heat medium circuit B so as to evaporate, thereby cooling the heat medium. This low-pressure two-phase refrigerant flows out of the intermediate heat exchanger 15*a*, flows out of the heat medium relay unit 3 via the second refrigerant flow channel switching device 13*a*, and again flows into the outdoor unit 1 via the refrigerant pipe 4.

The heat source side refrigerant flowing into the outdoor unit 1 flows into the heat-source-side heat exchanger 12, which serves as an evaporator, via the check valve 13*c*. Then, the refrigerant flowing into the heat-source-side heat exchanger 12 receives heat from outdoor air in the heat-source-side heat exchanger 12 and is transformed into a low-temperature low-pressure gas refrigerant. The low-temperature low-pressure gas refrigerant flowing out of the heat-source-side heat exchanger 12 is again sucked into the compressor 10 via the first refrigerant flow channel switching device 11 and the accumulator 19.

The saturated liquid temperature and the saturated gas temperature are calculated from the detected circulating composition and with the use of the first pressure sensor 36*b*, and the average temperature of the saturated liquid temperature and the saturated gas temperature is determined to be the condensing temperature. The opening degree of the expansion device 16*b* is controlled so that subcooling (degree of subcooling) obtained as a temperature difference between the temperature detected by the third temperature sensor 35*b* and the calculated condensing temperature will become constant. The expansion device 16*a* is set in the full opened state. The opening/closing device 17*a* is closed, and the opening/closing device 17*b* is closed. Alternatively, the expansion device 16*b* may be set in the full opened state, and subcooling may be controlled by the expansion device 16*a*. The circulating composition of the refrigerant circulating within the refrigeration cycle is measured in a manner similar to that measured in the cooling only operation. The opening/closing device 17*c* is opened.

Alternatively, by assuming, from the detected circulating composition and with the use of the third temperature sensor 35*b*, the temperature detected by the third temperature sensor 35*b* as the saturated liquid temperature or the temperature with respect to a set quality, the saturation pressure and the saturated gas temperature may be calculated. Then, the average temperature of the saturated liquid temperature and the saturated gas temperature may be determined to be the saturation temperature, and the determined saturation temperature may be used for controlling the expansion device 16*a* or 16*b*. In this case, the provision of the first pressure sensor 36*a* is not necessary, and the system can be constructed at low cost.

A description will now be given of the flow of a heat medium in the heat medium circuit B.

In the heating main operation mode, heating energy of a heat source side refrigerant is transmitted to a heat medium in the intermediate heat exchanger 15*b*, and the heated heat medium is made to pass through the pipes 5 by the pump 21*b*. Additionally, in the heating main operation mode, cooling energy of a heat source side refrigerant is transmitted to a heat medium in the intermediate heat exchanger 15*a*, and the cooled heat medium is made to pass through the pipes 5 by the pump 21*a*. The heat medium pressurized in the pumps 21*a* and 21*b* flows into the use side heat exchangers 26*b* and 26*a*, respectively, via the second heat-medium flow channel switching devices 23*b* and 23*a*, respectively.

In the use side heat exchanger 26*b*, the heat medium receives heat from indoor air, thereby cooling the indoor space 7. In the use side heat exchanger 26*a*, the heat medium transfers heat to indoor air, thereby heating the indoor space 7. In this case, due to the functions of the heat medium flow control devices 25*a* and 25*b*, the flow rate of the heat medium is set to be a flow rate which is necessary to satisfy an air conditioning load required indoors, and then, the heat medium flows into the use side heat exchangers 26*a* and 26*b*. The heat medium with a slightly increased temperature after passing through the use side heat exchanger 26*b* passes through the heat medium flow control device 25*b* and the first heat-medium flow channel switching device 22*b*, flows into the intermediate heat exchanger 15*a*, and is then sucked into the pump 21*a* again. The heat medium with a slightly reduced temperature after passing through the use side heat exchanger 26*a* passes through the heat medium flow control device 25*a* and the first heat-medium flow channel switching device 22*a*, flows into the intermediate heat exchanger 15*b*, and is then sucked into the pump 21*a* again.

During this operation, due to the functions of the first and second heat-medium flow channel switching devices 22 and 23, a heated heat medium and a cooled heat medium are respectively fed to a use side heat exchanger 26 with a heating load and a use side heat exchanger 26 with a cooling load without being mixed with each other. In the pipes 5 connected to the use side heat exchangers 26 for both of the heating side and the cooling side, a heat medium flows in the direction from the second heat-medium flow channel switching devices 23 to the first heat-medium flow channel switching devices 22 via the heat medium flow control devices 25. An air conditioning load required in the indoor space 7 can be satisfied by performing control so that, for the heating side, the difference between the temperature detected by the first temperature sensor 31*b* and the temperature detected by the second temperature sensor 34 will be maintained at a target value, and so that, for the cooling side, the difference between the temperature detected by the first temperature sensor 31*a* and the temperature detected by the second temperature sensor 34 will be maintained at a target value.

As has been discussed in the cooling only operation mode, the opening and closing of the heat medium flow control devices 25 is controlled, depending on whether or not there is a heat load.

[Refrigerant Pipes 4]

As described above, the air-conditioning apparatus 100 according to Embodiment has several operation modes, in these operation modes, a heat source side refrigerant flows through the refrigerant pipes 4 which connect the outdoor unit 1 and the heat medium relay unit 3.

[Pipes 5]

In some of the operation modes performed by the air-conditioning apparatus 100 according to Embodiment, a heat medium, such as water or an antifreeze, flows through the pipes 5 which connect the heat medium relay unit 3 and the indoor units 2.

{Operation Unique to Air-Conditioning Apparatus 100}

[Stable State Judgment Processing (1)]

As discussed above, when it is not necessary to measure the circulating composition again since the circulating composition has already been detected by the circulating-composition detecting circuit and the refrigeration cycle has become stable without any change, the opening/closing device 17*c* installed in the high/low pressure bypass pipe 4*c* is closed so as not to cause a refrigerant to flow through the high/low pressure bypass pipe 4*c*. The criteria for judging whether or not the refrigeration cycle is in a stable state will be discussed below.

If, in the refrigeration cycle, values, such as the high pressure, which is a pressure detected by the high pressure sensor 37, the low pressure, which is a pressure detected by the low pressure sensor 38, superheat at the outlet of an evaporator or the suction side of the compressor 10, and subcooling at the outlet of a condenser are maintained within certain ranges, the refrigeration cycle is considered to be in a stable state. Then, a description will be given of the level of deviation of these values from the stable state to such a degree as to determine that the refrigeration cycle has deviated from the stable state.

It is now assumed that the refrigeration cycle is stable, for example, the temperature detected by the high temperature sensor 32 is 44.0 degrees C., the pressure detected by the low pressure sensor 38 is 0.6 MPa, and the temperature detected by the low temperature sensor 33 is −3.0 degrees C. In this case, the circulating refrigerant composition is calculated to be as follows: the proportion made up of R32 is 37.4% and the proportion made up of HFO1234yf is 62.6%. By assuming this composition as a reference state, calculations are made to find how much the detected composition will deviate from the reference state if the values of the individual detectors are changed. The results are as follows.

A case in which the pressure detected by the low pressure sensor 38 is 0.625 MPa, that is, the pressure detected by the low pressure sensor 38 is increased from the reference state by 0.025 MPa, will be considered. In this case, if the temperature detected by the high temperature sensor 32 is maintained at 44.0 degrees C. and the temperature detected by the low temperature sensor 33 is maintained at −3.0 degrees C. without any change, the circulating refrigerant composition is calculated to be as follows: the proportion made up of R32 is 31.3% and the proportion made up of HFO1234yf is 68.7%, with the result that the circulating refrigerant composition is changed from the reference state by 6.1%.

A case in which the pressure detected by the low pressure sensor 38 is 0.575 MPa, that is, the pressure detected by the low pressure sensor 38 is decreased from the reference state by 0.025 MPa, will be considered. In this case, if the temperature detected by the high temperature sensor 32 is maintained at 44.0 degrees C. and the temperature detected by the low temperature sensor 33 is maintained at −3.0 degrees C. without any change, the circulating refrigerant composition is calculated to be as follows: the proportion made up of R32 is 43.0% and the proportion made up of HFO1234yf is 57.0%, with the result that the circulating refrigerant composition is changed from the reference state by 5.6%.

A case in which the temperature detected by the low temperature sensor 33 is −2.0 degrees C., that is, the temperature detected by the low temperature sensor 33 is increased from the reference state by 1 degree C., will be considered. In this case, if the temperature detected by the high temperature sensor 32 is maintained at 44.0 degrees C. and the pressure detected by the low pressure sensor 38 is maintained at 0.6 MPa without any change, the circulating refrigerant composition is calculated to be as follows: the proportion made up of R32 is 42.2% and the proportion made up of HFO1234yf is 57.8%, with the result that the circulating refrigerant composition is changed from the reference state by 4.8%.

A case in which the temperature detected by the low temperature sensor 33 is 4.0 degrees C., that is, the temperature detected by the law temperature sensor 33 is decreased from the reference state by 1 degree C., will be considered. In this case, if the temperature detected by the high temperature sensor 32 is maintained at 44.0 degrees C. and the pressure detected by the low pressure sensor 38 is maintained at 0.6 MPa without any change, the circulating refrigerant composition is calculated to be as follows: the proportion made up of R32 is 32.7% and the proportion made up of HFO1234yf is 67.3%, with the result that the circulating refrigerant composition is changed from the reference state by 4.7%.

A case in which the temperature detected by the high temperature sensor 32 is 54.0 degrees C., that is, the temperature detected by the high temperature sensor 32 is increased from the reference state by 10 degrees C., will be considered. In this case, if the pressure detected by the low pressure sensor 38 is maintained at 0.6 MPa and the temperature detected by the low temperature sensor 33 is maintained at −3.0 degrees C. without any change, the circulating refrigerant composition is calculated to be as follows: the proportion made up of R32 is 36.1% and the proportion made up of HFO1234yf is 63.9%, with the result that the circulating refrigerant composition is changed from the reference state by 1.3%.

A case in which the temperature detected by the high temperature sensor 32 is 34.0 degrees C., that is, the temperature detected by the high temperature sensor 32 is decreased from the reference state by 10 degrees C., will be considered. In this case, if the pressure detected by the low pressure sensor 38 is maintained at 0.6 MPa and the temperature detected by the low temperature sensor 33 is maintained at −3.0 degrees C. without any change, the circulating refrigerant composition is calculated to be as follows: the proportion made up of R32 is 38.7% and the proportion made up of HFO1234yf is 61.3%, with the result that the circulating refrigerant composition is changed from the reference state by 1.3%.

The above-described results show that the temperature detected by the high temperature sensor 32 does not significantly influence the detection of the circulating refrigerant composition.

If there has been a significant change in the circulating refrigerant composition and such a change has not been detected, the temperature glide is incorrectly interpreted, which fail to optimally control superheat and subcooling states, thereby decreasing the performance. For example, if there has been a change in the circulating refrigerant composition by 5% and such a change has not been detected, superheat deviates from a target value by about 2 degrees C. and subcooling deviates from about 2 degrees C., thereby decreasing COP by about 2%. On the other hand, by causing a refrigerant to flow through a circulating-composition detecting circuit, the flow rate of the refrigerant flowing through a condenser and an evaporator is reduced, and such a loss is about 2% in terms of COP. Accordingly, within a change in the circulating refrigerant composition of about 5% even if the circulating refrigerant composition is incorrectly interpreted, a decrease in COP caused by such a change in the circulating refrigerant composition is substantially the same as a loss in the circulating-composition detecting circuit. As a result, COP is not decreased.

Thus, in the air-conditioning apparatus 100, when a change in the circulating refrigerant composition from the stable state exceeds about 5%, it is determined that the refrigeration cycle has deviated from the stable state. That is, if a change in the pressure detected by the low pressure sensor 38 from the stable state is ±0.025 MPa or more or if a change in the temperature detected by the low temperature sensor 33 from the stable state is ±1 degree C. or more, it is determined that the refrigeration cycle has deviated from the stable state. In this case, the opening/closing device 17*c* is opened, and the circulating refrigerant composition is detected again. The temperature detected by the high temperature sensor 32 has very little influence on the precision in detecting the circulating refrigerant composition. However, a certain threshold is still required for the temperature detected by the high temperature sensor 32, and thus, if a change in the temperature detected by the high temperature sensor 32 from the stable state is ±10 degrees C., it is determined that the refrigeration cycle has deviated from the stable state. In this case, too, the opening/closing device 17*c* is opened, and the circulating refrigerant composition is detected again.

In contrast, if a change in the pressure detected by the low pressure sensor 38 from the stable state is less than ±0.025 MPa, and if a change in the temperature detected by the low temperature sensor 33 from the stable state is less than ±1 degree C., and if a change in the temperature detected by the high temperature sensor 32 from the stable state is less than ±10 degrees C., it is determined that the refrigeration cycle is in the stable state. In this case, the opening/closing device 17*c* is closed so as to prevent a refrigerant from flowing through the high/low pressure bypass pipe 4*c*.

Figure 11:
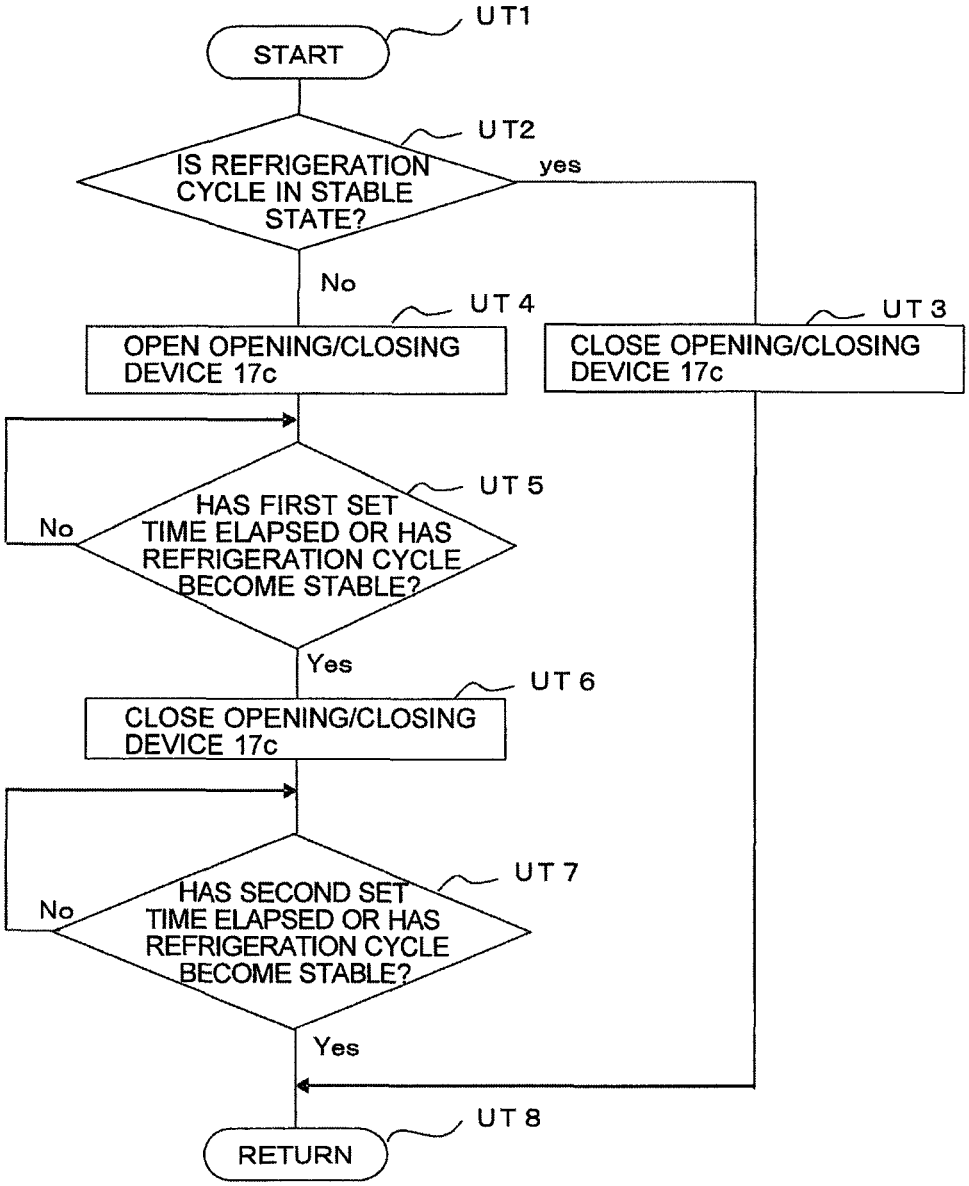
FIG. 11 is a flowchart illustrating a flow of stable state judgment processing (1) executed by a controller.

FIG. 11 is a flowchart illustrating a flow of stable state judgment processing (1). Stable state judgment processing (1) will be described below in detail with reference to FIG. 11. Stable state judgment processing (1) is executed by the controller 50.

First, processing is started (UT1). The controller 50 determines whether or not the refrigeration cycle is in the stable state (UT2). The criteria for judging whether or not the refrigeration cycle is in the stable state have been discussed above. If it is determined that the refrigeration cycle is in the stable state (UT2; Yes), the controller 50 closes the opening/closing device 17*c* (UT3), and completes the processing (UT8).

In contrast, if it is determined that the refrigeration cycle is not in the stable state (UT2; No), the controller 50 opens the opening/closing device 17*c* (UT4), and detects the circulating refrigerant composition. Then, the controller 50 maintains the state of the opening/closing device 17*c* until it is determined that a first preset time has elapsed or that the refrigeration cycle has become stable again (UT5; No). If the controller 50 determines that the first preset time has elapsed or the refrigeration cycle has become stable again (UT5; Yes), it closes the opening/closing device 17*c* (UT6).

Then, the controller 50 maintains the state of the opening/closing device 17*c* until it is determined that a second preset time has elapsed or that the refrigeration cycle has become stable again (UT7; No). If the controller 50 determines that the second preset time has elapsed or the refrigeration cycle has become stable again (UT7; Yes), it completes the processing (UT8). It is noted that when the opening/closing device 17*c* is opened or closed, the flow rate of a refrigerant changes. The first preset time and the second preset time are times necessary to wait for the changed flow rate to become stable, and may be set to be, for example, three minutes. However, the first preset time and the second preset time are not restricted to three minutes, and may be, for example, one minute.

[Stable State Judgment Processing (2)]

Figure 12:
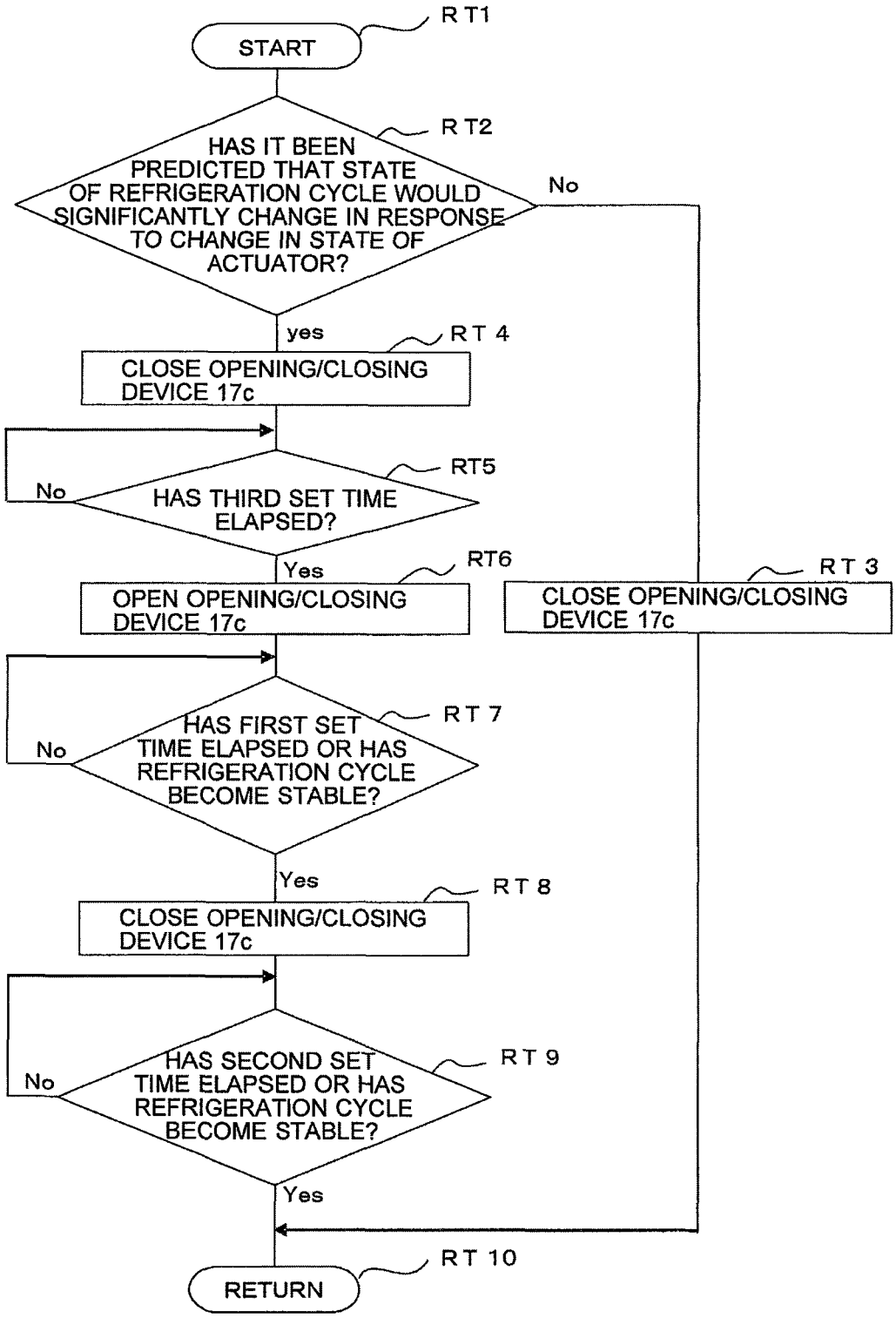
FIG. 12 is a flowchart illustrating a flow of stable state judgment processing (2) executed by the controller.

If it has been predicted that the state of the refrigeration cycle will significantly change since there has been a change in the state of an actuator (for example, one of driving components, such as the compressor 10, the first refrigerant flow channel switching device 11, the opening/closing device 17*a*, the opening/closing device 17*b*, the second refrigerant flow channel switching device 18*a*, and the second refrigerant flow channel switching device 18*b*, and so on) forming the refrigeration cycle, it is preferable that the opening/closing device 17*c* is controlled depending on a change in the actuator. With this arrangement, a higher controllability can be expected. FIG. 12 is a flowchart illustrating a flow of stable state judgment processing (2). Stable state judgment processing (2) will be described below in detail with reference to FIG. 12. Stable state judgment processing (2) is executed by the controller 50.

First, processing is started (RT1). When the processing is started, the state of an actuator is changed. The controller 50 determines whether or not it has been predicted that the state of the refrigeration cycle will significantly change in response to a change in the actuator (RT2). If it has been predicted that the state of the refrigeration cycle will not significantly change even if the actuator has been changed (RT2; No), the controller 50 closes the opening/closing device 17*c* (RT3), and completes the processing (RT10).

In contrast, if it has been predicted that the state of the refrigeration cycle will significantly change in response to a change in the actuator (RT2; Yes), the controller 50 closes the opening/closing device 17*c* (RT4), and maintains the state of the opening/closing device 17*c* until a third set time elapses (RT5). It is noted that when the opening/closing device 17*c* is opened or close, the flow rate of a refrigerant changes. The third set time is a time necessary to wait for the changed flow rate to become stable, and may be set to be, for example, three minutes or one minute. If the third set time has elapsed (RT5; Yes), the controller 50 opens the opening/closing device 17*c* (RT6), and detects the circulating composition. Then, the controller 50 maintains the state of the opening/closing device 17*c* until it is determined that a first preset time has elapsed or that the refrigeration cycle has become stable again (RT7; No). If the controller 50 determines that the first preset time has elapsed or the refrigeration cycle has become stable again (RT7; Yes closes the opening/closing device 17*c* (RT8).

Then, the controller 50 maintains the state of the opening/closing device 17*c* until it is determined that a second preset time has elapsed or that the refrigeration cycle has become stable again (RT9; No). If the controller 50 determines that the second preset time has elapsed or the refrigeration cycle has became stable again (RT9; Yes), it completes the processing (RT10). The first preset time and the second preset time are times, such as those discussed in the stable state judgment processing (1).

The case where it may be predicted that the state of the refrigeration cycle will significantly change due to a change in the state of an actuator may include the case where the first refrigerant flow channel switching device 11 forming the refrigeration cycle is switched from the heating side to the cooling side or from the cooling side to the heating side, the case where the compressor 10 is activated from its OFF state.

Additionally, when the operation mode is switched between the heating only operation mode and the heating main operation mode or between the cooling only operation mode and the cooling main operation mode, the state of one or a plurality of the opening/closing device 17*a*, the opening/closing device 17*b*, the second refrigerant flow channel switching device 18*a*, and the second refrigerant flow channel switching device 18*b* changes. Accordingly, it may be predicted that the operating state of the refrigeration cycle will significantly change. In the case of such a change in the operating state, it is desirable that similar processing is executed.

However, in response to a change in the expansion devices 16*a* and 16*b* and so on, it is determined whether the opening/closing device 17*c* has to be opened or closed in the stable state judgment processing (1) indicated by the flowchart of FIG. 11.

In FIG. 12, the reason why the opening/closing device 17*c* is closed (RT4) after the state of the actuator has changed and the state of the opening/closing device 17*c* is maintained until the third set time has elapsed (RT5) is that a refrigerant flowing through the bypass flow channel 4*c* is removed after the state of the actuator has changed so as to increase the flow rate of the refrigerant in the main circuit and to decrease the time taken for the refrigerant cycle to become stable. However, such an operation is not essential. By omitting RT4 and RT5, the opening/closing device may be opened (RT5) after the state of the actuator has changed, and the state of the opening/closing device may be maintained until it is determined that the first preset time has elapsed or that the refrigeration cycle has become stable again (RT7; No).

As the opening/closing device 17*c*, a device which opens or doses the flow channel depending on whether or not a voltage has been applied, such as a solenoid valve, may be used. Alternatively, a device which is driven by a stepping motor so as to sequentially change the opening area, such as an electronic expansion valve, may be used. As the opening/closing device 17*c*, any type of device may be used as long as it can open and close the flow channel. If an electronic expansion valve is used as the opening/closing device 17*c*, it can also serve as the expansion device 14. Accordingly, the provision of only one electronic expansion valve is sufficient without the need to provide both the opening/closing device 17*c* and the expansion device 14. In this case, the configuration is advantageously simplified. Disadvantageously, however, it takes time to respond to an operation of opening or closing of the flow channel. Moreover, if a fixed expansion device, such as a capillary tube, is used as the expansion device 14, the use of a solenoid valve and a capillary tube makes it possible to construct a system at lower cost than the use of an electronic expansion valve.

A description has been given of the case in which the pressure sensor 36*a* is installed in the flow channel between the second refrigerant flow channel switching device 18*a* and the intermediate heat exchanger 15*a*, which serves as a cooling side during the coaling and heating mixed operation, and the pressure sensor 36*b* is installed in the flow channel between the expansion device 16*b* and the intermediate heat exchanger 15*b*, which serves as a heating side during the cooling and heating mixed operation. By installing the pressure sensors 36*a* and 36*b* at such positions, even if a pressure drop occurs in the intermediate heat exchangers 15*a* and 15*b*, the saturation temperature can be calculated with high precision.

However, since a pressure drop occurring at a condensing side is small, the pressure sensor 36*b* may be installed in the flow channel between the intermediate heat exchanger 15*b* and the expansion device 16*b*, in which case, the calculation precision is not considerably decreased. Moreover, although a pressure drop occurring at an evaporator is comparatively large, if the amount of pressure drop is predictable or if an intermediate heat exchanger which causes only a small pressure drop is used, the pressure sensor 36*a* may be installed in the flow channel between the intermediate heat exchanger 15*a* and the second refrigerant flow channel switching device 18*a*.

In the air-conditioning apparatus 100, if only a heating load or only a cooling load is generated in the use side heat exchangers 26, the opening degrees of the associated first and second heat-medium flow channel switching devices 22 and 23 are set to be an intermediate opening degree, thereby allowing a heat medium to flow both through the intermediate heat exchangers 15*a* and 15*b*. With this arrangement, both of the intermediate heat exchangers 15*a* and 15*b* can be used for the heating operation or the cooling operation, and thus, the heat transfer area is increased, thereby implementing a high-efficiency heating operation or cooling operation.

In contrast, if both of a heating load and a cooling load are generated in the use side heat exchangers 26, the first and second heat-medium flow channel switching devices 22 and 23 corresponding to a use side heat exchanger 26 which performs a heating operation are switched to the flow channel connected to the intermediate heat exchanger 15*b* used for heating, and the first and second heat-medium flow channel switching devices 22 and 23 corresponding to a use side heat exchanger 26 which performs a cooling operation are switched to the flow channel connected to the intermediate heat exchanger 15*a* used for cooling. As a result, in each of the indoor units 2, a heating operation or a cooling operation can be performed as desired.

As the first and second heat-medium flow channel switching devices 22 and 23 discussed in Embodiment, any type of device that can switch the flow channel may be used. For example, devices that can switch a three-way passage, such as three-port valves, or a combination of two devices which each open and close a two-way passage, such as on/off valves, may be used. Alternatively, as the first and second heat-medium flow channel switching devices 22 and 23, a device that can change the flow rate of a three-way passage, such as a stepping motor driving type mixing valve, or a combination of two devices that can each change the flow rate of a two-way passage, such as electronic expansion valves, may be used. In this case, the occurrence of water hammer caused by the sudden opening or closing of a flow channel may be prevented. Additionally, in Embodiment, a case in which the heat medium flow control device 25 is a two-port valve has been discussed by way of example. However, the heat medium flow control device 25 may be a control valve having a three-way passage, and may be installed together with a bypass pipe that bypasses the use side heat exchanger 26.

As the heat medium flow control device 25, a stepping motor driving type device that can control the flow rate of a refrigerant flowing through a flow channel may be used, in which case, a two-port valve or a three-port valve with one port closed may be used. Alternatively, as the heat medium flow control device 25, a device that opens and closes a two-way passage, such as an on/off valve, may be used, in which case, the heat medium flow control device 25 may control an average flow rate by repeating ON/OFF operations.

As stated above, a four-port valve may be used as the second refrigerant flow channel switching device 18. However, the second refrigerant flow channel switching device 18 is not restricted to a four-port valve. Instead, a plurality of two-way passage switching valves or three-way passage switching valves may be used, and may be configured such that a refrigerant flows therethrough similarly to the case in which a four-port valve is used.

A description has been given of a case in which the air-conditioning apparatus 100 according to Embodiment can perform a cooling and heating mixed operation. However, the air-conditioning apparatus 100 is not restricted to this configuration. The air-conditioning apparatus 100 may be configured such that it performs the cooling operation only or the heating operation only, in which case, only one intermediate heat exchanger 15 and only one expansion device 16 are provided, and the plurality of use side heat exchangers 26 and the plurality of heat medium flow control devices 25 are connected in parallel with the intermediate heat exchanger 15 and the expansion device 16. Even with this configuration, advantages similar to those described above can be achieved.

Needless to say that, even when only one use side heat exchanger 26 and only one heat medium flow control device 25 are connected, advantages similar to those described above may be achieved. Further, as each of the intermediate heat exchanger 15 and the expansion device 16, a plurality of devices which function in the same manner may be provided without any problem. Moreover, a case in which the heat medium flow control device 25 is contained within the heat medium relay unit 3 has been discussed by way of example. However, this is not the only case, and the heat medium flow control device 25 may be contained in the indoor unit 2, or may be configured as a separate body different from the heat medium relay unit 3 and the indoor unit 2.

As a heat medium, for example, brine (antifreeze) or water, a mixed solution of brine and water, a mixed solution of water and an additive having a high anticorrosive effect, and so on, may be used. Accordingly, in the air-conditioning apparatus 100, even if a heat medium leaks to the indoor space 7 via the indoor unit 2, the air-conditioning apparatus 100 still contributes to the enhancement of safety since a highly safe heat medium is used.

In Embodiment, a case in which the accumulator 19 is included in the air-conditioning apparatus 100 has been discussed by way of example. However, the provision of the accumulator 19 may be omitted. Generally, in many cases, an air-sending device is fixed to the heat-source-side heat exchanger 12 and the use side heat exchangers 26, thereby accelerating condensation or evaporation by sending air. However, the heat-source-side heat exchanger 12 and the use side heat exchangers 26 are not restricted to this type. For example, as the use side heat exchangers 26, a panel heater utilizing radiation may be used, and as the heat-source-side heat exchanger 12, a water-cooled type device which can transfer heat by using water or an antifreeze may be used. Any type of device may be used as the heat-source-side heat exchanger 12 and the use side heat exchangers 26 as long as it is configured such that it can transfer or receive heat.

In Embodiment, a case in which four use side heat exchangers 26 are provided has been discussed by way of example. However, the number of use side heat exchangers 26 is not particularly restricted. Additionally, a case in which two intermediate heat exchangers 15*a* and 15*b* are provided has been discussed by way of example. However, the number of intermediate heat exchangers 15 is not restricted to two, and any number of intermediate heat exchangers 15 may be installed as long as they are configured such that they can cool and/or heat a heat medium. Moreover, the number of pumps 21*a* and the number of pumps 21*b* is not restricted to one, and a plurality of small-capacity pumps may be connected in parallel with each other.

In Embodiment, the following system has been discussed by way of example. The compressor 10, the first refrigerant flow channel switching device 11, the heat-source-side heat exchanger 12, the high/low pressure bypass pipe 4*c*, the expansion device 14, the inter-refrigerant heat exchanger 20, the high temperature sensor 32, the low temperature sensor 33, the high pressure sensor 37, the low pressure sensor 38, and the opening/closing device 17*c* are stored in the outdoor unit 1. The use side heat exchangers 26 are stored in the indoor units 2, and the intermediate heat exchangers 15 and the expansion devices 16 are stored in the heat medium relay unit 3. Then, the outdoor unit 1 and the heat medium relay unit 3 are connected to each other with a pair of two pipes, and a refrigerant is caused to circulate between the outdoor unit 1 and the heat medium relay unit 3. The indoor units 2 and the heat medium relay unit 3 are connected to each other with a pair of two pipes, and a heat medium is caused to circulate between the indoor units 2 and the heat medium relay unit 3. Heat exchange between the refrigerant and the heat medium is performed in the intermediate heat exchangers 15. However, Embodiment is not restricted to such a system.

For example, the compressor 10, the first refrigerant flow channel switching device 11, the heat-source-side heat exchanger 12, the high/low pressure bypass pipe 4*c*, the expansion device 14, the inter-refrigerant heat exchanger 20, the high-pressure-side refrigerant temperature detector 32, the low-pressure-side refrigerant temperature detector 33, the high-pressure-side refrigerant pressure detector 37, the low-pressure-side refrigerant pressure detector 38, and the opening/closing device 17*c* may be stored in the outdoor unit 1. The expansion devices 16 and a load side heat exchanger, which performs heat exchange between air in an air-conditioned space and a refrigerant, may be stored in the indoor unit 2. A relaying unit, which is formed separately from the outdoor unit 1 and the indoor unit 2, may be provided. The outdoor unit 1 and the relaying unit may be connected to each other with a pair of two pipes, and the indoor unit 2 and the relaying unit may be connected to each other with a pair of two pipes. A refrigerant is caused to circulate between the outdoor unit 1 and the indoor unit 2 via the relaying unit. With this configuration, a cooling only operation, a heating only operation, a cooling main operation, and a heating main operation can be performed. The present invention is also applicable to such a direct expansion system, and similar advantages can be achieved.

As described above, the air-conditioning apparatus 100 according to Embodiment implements, not only the enhancement of safety by preventing a heat side refrigerant from circulating in the indoor units 2 or near the indoor units 2, but also the detection of the composition of a refrigerant by opening the opening/closing device 17*c* if a refrigeration cycle deviates from a stable state, thereby making it possible to improve energy efficiency when a refrigeration cycle is in a stable state. As a result, the energy efficiency can be reliably improved. Additionally, in the air-conditioning apparatus 100, the length of the pipes 5 can be decreased, thereby achieving energy saving. Moreover, in the air-conditioning apparatus 100, the number of connecting pipes (refrigerant pipes 4 and pipes 5) between the outdoor unit 1 and the heat medium relay unit 3 or the indoor units 2 is decreased, thereby enhancing the ease of construction.

REFERENCE SIGNS LIST

1 outdoor unit, 2 indoor unit, 2*a* indoor unit, 2*b* indoor unit, 2*c* indoor unit, 2*d* indoor unit, 3 heat medium relay unit, 4 refrigerant pipe, 4*a* first connecting pipe, 4*b* second connecting pipe, 4*c* high/low pressure bypass pipe, 5 pipe, 6 outdoor space, 7 indoor space, 8 space, 9 building, 10 compressor, 11 first refrigerant flow channel switching device, 12 heat-source-side heat exchanger, 13*a* check valve, 13*b* check valve, 13*c* check valve, 13*d* check valve, 14 expansion device, 15 intermediate heat exchanger, 15*a* intermediate heat exchanger, 15*b* intermediate heat exchanger, 16 expansion device, 16*a* expansion device, 16*b* expansion device, 17 opening/closing device, 17*a* opening/closing device, 17*b* opening/closing device, 17*c* opening/closing device, 18 second refrigerant flow channel switching device, 18*a* second refrigerant flow channel switching device, 18*b* second refrigerant flow channel switching device, 19 accumulator, 20 inter-refrigerant heat exchanger,

21 pump, 21*a* pump, 21*b* pump, 22 first heat-medium flow channel switching device, 22*a* first heat-medium flow channel switching device, 22*b* first heat-medium flow channel switching device, 22*c* first heat-medium flow channel switching device, 22*d* first heat-medium flow channel switching device, 23 second heat-medium flow channel switching device, 23*a* second heat-medium flow channel switching device, 23*b* second heat-medium flow channel switching device, 23*c* second heat-medium flow channel switching device, 23*d* second heat-medium flow channel switching device, 25 heat medium flow control device, 25*a* heat medium flow control device, 25*b* heat medium flow control device, 25*c* heat medium flow control device, 25*d* heat medium flow control device, 26 use side heat exchanger, 26*a* use side heat exchanger, 26*b* use side heat exchanger, 26*c* use side heat exchanger, 26*d* use side heat exchanger, 31 first temperature sensor, 31*a* first temperature sensor, 31*b* first temperature sensor, 32 high-pressure-side refrigerant temperature detector (high temperature sensor), 33 low-pressure-side refrigerant temperature detector (low temperature sensor), 34 second temperature sensor, 34*a* second temperature sensor, 34*b* second temperature sensor, 34*c* second temperature sensor, 34*d* second temperature sensor, 35 third temperature sensor, 35*a* third temperature sensor, 35*b* third temperature sensor, 35*c* third temperature sensor, 35*d* third temperature sensor, 36 pressure sensor, 36*a* pressure sensor, 36*b* pressure sensor, 37 high-pressure-side refrigerant pressure detector (high pressure sensor), 38 low-pressure-side refrigerant pressure detector (low pressure sensor), 50 controller, 100 air-conditioning apparatus, A refrigerant circuit, B heat medium circuit.

The invention claimed is:

1. An air-conditioning apparatus in which a refrigeration cycle is formed by connecting a compressor, a refrigerant flow channel switching device, a first heat exchanger, a first expansion device, and a second heat exchanger to one another with a refrigerant pipe and by causing a refrigerant that is a refrigerant mixture to circulate within the refrigerant pipe, the air-conditioning apparatus comprising:

a pressure bypass pipe that connects a flow channel at a discharge side of the compressor and a flow channel at a suction side of the compressor;

a second expansion device that is disposed in the pressure bypass pipe and decompresses the refrigerant flowing through the pressure bypass pipe;

an inter-refrigerant heat exchanger that performs heat exchange between the refrigerant flowing on a front side of the second expansion device through the pressure bypass pipe and the refrigerant flowing on a behind side of the second expansion device through the pressure bypass pipe;

a bypass-channel opening and closing device that is disposed in the pressure bypass pipe and opens and closes the flow channel of the pressure bypass pipe; and a controller, the controller is configured to calculate a composition ratio of the refrigerant mixture by using a low-pressure-side pressure of the refrigerant to be sucked into the compressor, a high-pressure-side temperature of the refrigerant at an inlet side of the second expansion device in the pressure bypass pipe, and a low-pressure-side temperature of the refrigerant at an outlet side of the second expansion device in the pressure bypass pipe, determine whether an operating state of the refrigeration cycle is a stable state in which all of the low-pressure-side pressure, the low-pressure-side temperature of the refrigerant at the outlet side of the second expansion device in the pressure bypass pipe, and the high-pressure-side temperature of the refrigerant at the inlet side of the second expansion device in the pressure bypass pipe are within respective predetermined ranges while the refrigeration cycle is in operation, close the bypass-channel opening and closing device when the refrigeration cycle is determined to be in the stable state, and then not re-calculate the composition ratio of the refrigerant mixture, and open the bypass-channel opening and closing device when the refrigeration cycle is determined to be not in the stable state, and then after opening the bypass-channel opening and closing device, re-calculate the composition ratio of the refrigerant mixture and control the compressor and the first expansion device on a basis of a result of the re-calculation of the composition ratio of the refrigerant mixture.

2. The air-conditioning apparatus of claim 1, wherein, after the controller has opened the bypass-channel opening and closing device when the refrigeration cycle is determined to be not in the stable state, the controller is further configured to determine whether the refrigeration cycle becomes in the stable state, close the bypass-channel opening and closing device when the refrigeration cycle is determined to become in the stable state, and continue to maintain the bypass-channel opening and closing device in the open state when the refrigeration cycle is determined to not become in the stable state.

3. The air-conditioning apparatus of claim 1, wherein the controller determines that the low-pressure-side pressure has been within the predetermined range when an amount of change in the low-pressure-side pressure that is a deviation from a value of the low-pressure-side pressure observed when the low-pressure-side pressure is in the stable state while the refrigeration cycle is in operation is less than ±0.025 MPa; and the controller determines that the low-pressure-side pressure is not within the predetermined range when an amount of change in the low-pressure-side pressure that is a deviation from the value of the low-pressure-side pressure observed when the low-pressure-side pressure is in the stable state while the refrigeration cycle is in operation is ±0.025 MPa or more.

4. The air-conditioning apparatus of claim 1, wherein the controller determines that the low-pressure-side temperature is within a predetermined range when an amount of change in the low-pressure-side temperature that is a deviation from a value of the low-pressure-side temperature observed when the low-pressure-side temperature is in the stable state while the refrigeration cycle is in operation is less than ±1 degree C.; and the controller determines that the low-pressure-side temperature is not within the predetermined range when an amount of change in the low-pressure-side temperature that is a deviation from the value of the low-pressure-side temperature observed when the low-pressure-side temperature is in the stable state while the refrigeration cycle is in operation is ±1 degree C. or more.

5. The air-conditioning apparatus of claim 1, wherein the controller determines that the high-pressure-side temperature is within the predetermined range when an amount of change in the high-pressure-side temperature that is a deviation from a value of the high-pressure-side temperature observed when the high-pressure-side temperature is in the stable state while the refrigeration cycle is in operation is less than ±10 degrees C.; and the controller determines that the high-pressure-side temperature is not within the predetermined range when an amount of change in the high-pressure-side temperature that is a deviation from the value of the high-pressure-side temperature observed when the high-pressure-side temperature is in the stable state while the refrigeration cycle is in operation is ±10 degrees C. or more.

6. The air-conditioning apparatus of claim 2, wherein when the controller has predicted that the state of the refrigeration cycle will change since a state of a driving component forming the refrigeration cycle has changed, the controller, while opening the bypass-channel opening and closing device, when the first preset time elapses or when each of the low-pressure-side pressure, the low-pressure-side temperature, and the high-pressure-side temperature has been within the respective predetermined range again, closes the bypass-channel opening and closing device; and maintains a closed state of the bypass-channel opening and closing device until the second preset time elapses or until each of the low-pressure-side pressure, the low-pressure-side temperature and the high-pressure-side temperature has been within the respective predetermined range again.

7. The air-conditioning apparatus of claim 6, wherein, when the compressor is started or when the refrigerant flow channel switching device performs a switching operation, the controller predicts that the state of the refrigeration cycle will change.

8. The air-conditioning apparatus of claim 6, wherein a plurality of the second heat exchangers are provided, and the air-conditioning apparatus has a heating only operation mode in which all of the second heat exchangers in operation generate heating energy, a cooling only operation mode in which all of the second heat exchangers in operation generate cooling energy, and a cooling and heating mixed operation mode in which at least one of the second heat exchangers in operation generates heating energy and rest of the second heat exchangers in operation generates cooling energy; and when there has been a change in an operation mode among the operation modes, the controller predicts that the state of the refrigeration cycle will change.

9. The air-conditioning apparatus of claim 1, wherein a first unit in which the compressor, the refrigerant flow channel switching device, the first heat exchanger, the pressure bypass pipe, the second expansion device, and the inter-refrigerant heat exchanger are stored and a second unit in which at least the second heat exchanger is stored are formed as separate entities such that the first unit and the second unit are installable at separate positions;

the controller is mounted in the first unit; and a control unit which is connected to the controller wirelessly or with a wired medium such that the control unit and the controller are capable of communicating with each other and which receives information concerning the composition ratio of the refrigerant mixture calculated by the controller is mounted in the second unit.

10. The air-conditioning apparatus of claim 1, wherein the refrigerant mixture includes components expressed by $CF_3CFCH_2$ and R32.

* * * * *